US009476109B2

(12) United States Patent
Kuwagaki

(10) Patent No.: US 9,476,109 B2
(45) **Date of Patent: *Oct. 25, 2016**

(54) CU—NI—SI—CO COPPER ALLOY FOR ELECTRONIC MATERIAL AND PROCESS FOR PRODUCING SAME

(75) Inventor: Hiroshi Kuwagaki, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 689 days.

This patent is subject to a terminal disclaimer.

(21) Appl. No.: 13/638,431

(22) PCT Filed: Mar. 25, 2011

(86) PCT No.: PCT/JP2011/057436

§ 371 (c)(1),
(2), (4) Date: Sep. 28, 2012

(87) PCT Pub. No.: WO2011/125554

PCT Pub. Date: Oct. 13, 2011

(65) Prior Publication Data

US 2013/0022492 A1 Jan. 24, 2013

(30) Foreign Application Priority Data

Mar. 31, 2010 (JP) ..... 2010-083865

(51) Int. Cl.
*C22C 9/06* (2006.01)
*C22C 1/02* (2006.01)
(Continued)

(52) U.S. Cl.
CPC . *C22C 9/06* (2013.01); *C22C 1/02* (2013.01); *C22F 1/08* (2013.01); *H01B 1/026* (2013.01)

(58) Field of Classification Search
CPC ..... C22C 1/02; C22C 9/06; C22F 1/08; H01B 1/026
USPC ..... 420/469, 481, 485, 486, 487, 488, 490, 420/496; 148/553, 554
See application file for complete search history.

(56) References Cited

U.S. PATENT DOCUMENTS 8,070,893 B2 * 12/2011 Era et al. ..... 148/435
8,317,948 B2 * 11/2012 Era et al. ..... 148/435
(Continued)

FOREIGN PATENT DOCUMENTS

CN 101168829 A 4/2008
CN 101646791 A 2/2010
(Continued)

OTHER PUBLICATIONS

Era, JP 2009-242890 Machine Translation.*
(Continued)

*Primary Examiner* — Jessee Roe
*Assistant Examiner* — John Hevey
(74) *Attorney, Agent, or Firm* — Drinker Biddle & Reath LLP

(57) ABSTRACT

A Cu—Ni—Si—Co system alloy having an improved spring bending elastic limit is provided. The alloy is a copper alloy for electronic materials, which contains 1.0% to 2.5% by mass of Ni, 0.5% to 2.5% by mass of Co, and 0.3% to 1.2% by mass of Si, with the balance being Cu and unavoidable impurities, wherein from the results obtainable by an X-ray diffraction pole figure analysis using a rolled surface as a base, among the diffraction peak intensities of the {111}Cu plane with respect to the {200}Cu plane obtained by β scanning at α=35°, the peak height at a β angle of 90° of the copper alloy is at least 2.5 times the peak height of a standard copper powder.

12 Claims, 3 Drawing Sheets

(51) Int. Cl.

| | |
|---|---|
| ***C22F 1/08*** | (2006.01) |
| ***H01B 1/02*** | (2006.01) |

(56) References Cited

U.S. PATENT DOCUMENTS

| | | | | |
|---|---|---|---|---|
| 8,444,779 | B2 * | 5/2013 | Era et al. | 148/435 |
| 2004/0079456 | A1 | 4/2004 | Mandigo et al. | 148/554 |
| 2007/0062619 | A1 * | 3/2007 | Maehara et al. | 148/554 |
| 2008/0056930 | A1 | 3/2008 | Ito et al. | |
| 2008/0099110 | A1 | 5/2008 | Muroga et al. | |
| 2009/0165899 | A1 | 7/2009 | Sakai et al. | |
| 2010/0170595 | A1 | 7/2010 | Kaneko et al. | |
| 2010/0326573 | A1 | 12/2010 | Mihara et al. | |
| 2011/0027122 | A1 * | 2/2011 | Era et al. | 420/473 |
| 2011/0186192 | A1 | 8/2011 | Mihara et al. | |
| 2011/0240182 | A1 * | 10/2011 | Kuwagaki | 148/682 |
| 2011/0244260 | A1 * | 10/2011 | Kuwagaki | 428/546 |
| 2012/0031533 | A1 | 2/2012 | Onda et al. | |
| 2013/0022492 | A1 | 1/2013 | Kuwagaki | |
| 2013/0087255 | A1 * | 4/2013 | Kuwagaki | 148/554 |
| 2013/0263978 | A1 * | 10/2013 | Kuwagaki | 148/554 |
| 2014/0014240 | A1 * | 1/2014 | Okafuji et al. | 148/554 |
| 2014/0014241 | A1 * | 1/2014 | Kuwagaki et al. | 148/554 |

FOREIGN PATENT DOCUMENTS

| | | | | |
|---|---|---|---|---|
| CN | 101680056 | A | 3/2010 | |
| CN | 101952465 | A | 1/2011 | |
| JP | 07-011363 | A | 1/1995 | |
| JP | 2005-532477 | | 10/2005 | C22F 1/08 |
| JP | 2006-283059 | A | 10/2006 | |
| JP | 2007-092135 | A | 4/2007 | |
| JP | 2007-169765 | | 7/2007 | C22F 1/00 |
| JP | 2008-013836 | A | 1/2008 | |
| JP | 2008-056977 | A | 3/2008 | |
| JP | 2008-106312 | A | 5/2008 | |
| JP | 2008-106313 | A | 5/2008 | |
| JP | 2009-242890 | | 10/2009 | C22F 1/02 |
| JP | 2009-242890 | A | 10/2009 | |
| JP | 2009-242921 | A | 10/2009 | |
| JP | 2010-215976 | A | 9/2010 | |
| JP | 2010-236071 | A | 10/2010 | |
| JP | 2011-214088 | A | 10/2011 | |
| JP | 2011-252209 | A | 12/2011 | |
| TW | 201003674 | A | 1/2010 | |
| WO | 2004005560 | A2 | 1/2004 | |
| WO | 2007148712 | A1 | 12/2007 | |
| WO | 2010013790 | A1 | 2/2010 | |
| WO | 2010064547 | A1 | 6/2010 | |
| WO | 2010113553 | A1 | 10/2010 | |

OTHER PUBLICATIONS

Supplementary European Search Report in European Application 117654.55 dated Feb. 14, 2014 (the European regional phase of PCT/JP2011/057436).
Office Action for U.S. Appl. No. 13/993,648 dated Apr. 22, 2015.
Office Action for U.S. Appl. No. 13/993,648 dated Jun. 26, 2015.
Office Action for U.S. Appl. No. 13/993,648 dated Dec. 15, 2015.
Office Action for U.S. Appl. No. 14/008,035 dated Apr. 22, 2015.
Office Action for U.S. Appl. No. 14/008,035 dated Jul. 8, 2015.
Office Action for U.S. Appl. No. 14/008,035 dated Dec. 16, 2015.
Office Action for U.S. Appl. No. 14/006,735 dated Apr. 22, 2015.
Office Action for U.S. Appl. No. 14/006,735 dated Jun. 26, 2015.
Office Action for U.S. Appl. No. 14/006,735 dated Dec. 17, 2015.

* cited by examiner

CU—NI—SI—CO COPPER ALLOY FOR ELECTRONIC MATERIAL AND PROCESS FOR PRODUCING SAME

TECHNICAL FIELD

The present invention relates to a precipitation hardened copper alloy, and more particularly, to a Cu—Ni—Si—Co system copper alloy suitable for the use in various electronic components.

BACKGROUND ART

Copper alloys for electronic materials used in various electronic components such as connectors, switches, relays, pins, terminals and lead frames, are required to achieve a balance between high strength and high electrical conductivity (or thermal conductivity) as basic characteristics. In recent years, high integration, small and thin type electronic components are in rapid progress, and in this respect, the demand for a copper alloy to be used in the components of electronic equipment is rising to higher levels.

From the viewpoints of high strength and high electrical conductivity, the amount of use of precipitation hardened copper alloys is increasing in replacement of conventional solid solution hardened copper alloys represented by phosphor bronze and brass, as copper alloys for electronic materials. In a precipitation hardened copper alloy, as a supersaturated solid solution that has been solution heat treated is subjected to an aging treatment, fine precipitates are uniformly dispersed, so that the strength of the alloy increases and the amount of solid-solution elements in copper decreases, increasing electrical conductivity. For this reason, a material having excellent mechanical properties such as strength and spring properties, and having satisfactory electrical conductivity and heat conductivity is obtained.

Among precipitation hardened copper alloys, Cu—Ni—Si system copper alloys, which are generally referred to as Corson system alloys, are representative copper alloys having relatively high electrical conductivity, strength and bending workability in combination, and constitute one class of alloys for which active development is currently underway in the industry. In this class of copper alloys, an enhancement of strength and electrical conductivity can be promoted by precipitating fine Ni—Si intermetallic compound particles in a copper matrix.

Recently, attention is paid to Cu—Ni—Si—Co system alloys produced by adding Co to Cu—Ni—Si system copper alloys, and technology improvement is in progress. Japanese Patent Application Laid-Open No. 2009-242890 (Patent Literature 1) describes an invention in which the number density of second phase particles having a particle size of 0.1 μm to 1 μm is controlled to $5\times10^5$ to $1\times10^7$ particles/mm$^2$, in order to increase the strength, electrical conductivity and spring bending elastic limit of Cu—Ni—Si—Co system alloys.

This document discloses a method for producing a copper alloy, the method including conducting the following steps in order:

step 1 of melting and casting an ingot having a desired composition;

step 2 of heating the material for one hour or longer at a temperature of from 950° C. to 1050° C., subsequently performing hot rolling, adjusting the temperature at the time of completion of hot rolling to 850° C. or higher, and cooling the material with an average cooling rate from 850° C. to 400° C. at 15° C./s or greater;

step 3 of performing cold rolling;

step 4 of conducting a solution heat treatment at a temperature of from 850° C. to 1050° C., cooling the material at an average cooling rate of greater than or equal to 1° C./s and less than 15° C./s until the material temperature falls to 650° C., and cooling the material at an average cooling rate of 15° C./s or greater until the material temperature falls from 650° C. to 400° C.;

step 5 of conducting a first aging treatment at a temperature of higher than or equal to 425° C. and lower than 475° C. for 1 to 24 hours;

step 6 of performing cold rolling; and step 7 of conducting a second aging treatment at a temperature of higher than or equal to 100° C. and lower than 350° C. for 1 to 48 hours.

Japanese Patent Application National Publication (Laid-Open) No. 2005-532477 (Patent Literature 2) describes that in a production process for a Cu—Ni—Si—Co alloy, various annealing can be carried out as stepwise annealing processes, so that typically, in stepwise annealing, a first process is conducted at a temperature higher than that of a second process, and stepwise annealing may result in a more satisfactory combination of strength and conductivity as compared with annealing at a constant temperature.

CITATION LIST

Patent Literature 1: JP No. 2009-242890A
Patent Literature 2: JP No. 2005-532477A

SUMMARY OF INVENTION

Technical Problem

According to the copper alloy described in Patent Literature 1, a Cu—Ni—Si—Co alloy for electronic materials having enhanced strength, electrical conductivity and spring bending elastic limit is obtained; however, there is still room for improvement. Patent Literature 2 suggests stepwise annealing, but there are no descriptions on the specific conditions, and there is no suggestion that spring bending elastic limit increases. Thus, it is an object of the present invention to provide a Cu—Ni—Si—Co alloy which is based on the alloy of Patent Literature 1, with a further improved spring bending elastic limit. Furthermore, it is another object of the present invention to provide a method for producing such a Cu—Ni—Si—Co alloy.

Solution to Problem

The inventors of the present invention conducted thorough investigations in order to solve the problems described above, and the inventors found that when the first aging treatment described in Patent Literature 1 is modified, and multistage aging is carried out in three stages under particular temperature and time conditions, strength and electrical conductivity as well as spring bending elastic limit are significantly enhanced. Thus, the inventors have investigated the cause, and found that the alloy is unique in that with regard to the crystal orientation of a rolled surface obtainable by an X-ray diffraction method, the peak height at a β angle of 90° among the diffraction peaks of the {111}Cu plane, which is in a positional relationship of 55° (under the measurement conditions, α=35°) with respect to the {200}Cu plane of the rolled surface, is at least 2.5 times the peak height of copper powder. The reason why such diffraction peaks are obtained is not clearly understood, but it is speculated that a fine distribution state of second phase particles is exerting influence.

According to an aspect of the present invention that has been completed based on the findings described above, there is provided a copper alloy for electronic materials containing 1.0% to 2.5% by mass of Ni, 0.5% to 2.5% by mass of Co, and 0.3% to 1.2% by mass of Si, with the balance being Cu and unavoidable impurities, wherein from the results obtainable by an X-ray diffraction pole figure analysis using a rolled surface as a base, among the diffraction peak intensities of the {111}Cu plane with respect to the {200}Cu plane obtained by β scanning at α=35°, the peak height at a β angle of 90° of the copper alloy is at least 2.5 times the peak height of a standard copper powder.

According to an embodiment, the copper alloy related to the present invention is such that the number density of particles having a particle size of from 0.1 μm to 1 μm among the second phase particles precipitated in the matrix phase is $5\times10^5$ to $1\times10^7$ particles/mm$^2$.

According to another embodiment, the copper alloy related to the present invention satisfies the following formulas:

$$-14.6\times(\text{Ni concentration}+\text{Co concentration})^2+165\times(\text{Ni concentration}+\text{Co concentration})+544\geq YS\geq-14.6\times(\text{Ni concentration}+\text{Co concentration})^2+165\times(\text{Ni concentration}+\text{Co concentration})+512.3, \quad \text{Formula A:}$$

and $$20\times(\text{Ni concentration}+\text{Co concentration})+625\geq Kb\geq20\times(\text{Ni concentration}+\text{Co concentration})+520 \quad \text{Formula B:}$$

wherein the unit of the Ni concentration and the Co concentration is percent (%) by mass; YS represents 0.2% yield strength; and Kb represents spring bending elastic limit.

According to another embodiment, the copper alloy related to the present invention is such that the relationship between Kb and YS satisfies the following formula:

$$0.23\times YS+480\geq Kb\geq0.23\times YS+390 \quad \text{Formula C:}$$

wherein YS represents 0.2% yield strength; and Kb represents spring bending elastic limit.

According to still another embodiment, the copper alloy related to the present invention is such that the ratio of the total mass concentration of Ni and Co to the mass concentration of Si, [Ni+Co]/[Si], satisfies the relationship:

$$4\leq[\text{Ni}+\text{Co}]/\text{Si}\leq5.$$

According to still another embodiment, the copper alloy related to the present invention further contains Cr: 0.03% to 0.5% by mass.

According to still another embodiment, the copper alloy related to the present invention further contains at least one selected from the group consisting of Mg, P, As, Sb, Be, B, Mn, Sn, Ti, Zr, Al, Fe, Zn and Ag in a total amount of 2.0% by mass at the maximum.

According to another aspect of the present invention, there is provided a method for producing a copper alloy such as described above, the method including performing the following steps in order:

step 1 of melting and casting an ingot of a copper alloy having the composition described above;

step 2 of heating the material for one hour or longer at a temperature of from 950° C. to 1050° C., subsequently performing hot rolling, adjusting the temperature at the time of completion of hot rolling to 850° C. or higher, and cooling the material with an average cooling rate from 850° C. to 400° C. at 15° C./s or greater;

step 3 of performing cold rolling;

step 4 of conducting a solution heat treatment at a temperature of from 850° C. to 1050° C., and cooling the material with an average cooling rate to 400° C. at 10° C. or more per second;

step 5 of conducting a first aging treatment involving multistage aging, which includes a first stage of heating the material at a material temperature of 400° C. to 500° C. for 1 to 12 hours, subsequently a second stage of heating the material at a material temperature of 350° C. to 450° C. for 1 to 12 hours, and subsequently a third stage of heating the material at a material temperature of 260° C. to 340° C. for 4 to 30 hours, wherein the cooling rate from the first stage to the second stage and the cooling rate from the second stage to the third stage is set at 1° C. to 8° C./min, respectively, the temperature difference between the first stage and the second stage is adjusted to 20° C. to 60° C., and the temperature difference between the second stage and the third stage is adjusted to 20° C. to 180° C.;

step 6 of performing cold rolling; and step 7 of conducting a second aging treatment at a temperature of higher than or equal to 100° C. and lower than 350° C. for 1 to 48 hours.

According to an embodiment, the method for producing a copper alloy related to the present invention is carried out such that, after the solution heat treatment in step 4, instead of the cooling conditions of cooling with an average cooling rate to 400° C. at 10° C. or more per second, cooling is carried out at an average cooling rate of greater than or equal to 1° C./s and less than 15° C./s until the material temperature falls to 650° C., and at an average cooling rate of 15° C./s or greater until the temperature falls from 650° C. to 400° C.

According to another embodiment, the method for producing a copper alloy related to the present invention further includes step 8 of performing acid pickling and/or polishing, after the step 7.

According to still another aspect of the present invention, there is provided a wrought copper product made of the copper alloy related to the present invention.

According to still another aspect of the present invention, there is provided an electronic component containing the copper alloy related to the present invention.

Advantageous Effects of Invention

According to the present invention, a Cu—Ni—Si—Co alloy for electronic materials which is excellent in all of strength, electrical conductivity and spring bending elastic limit, is provided.

DESCRIPTION OF EMBODIMENTS

Figure 1:
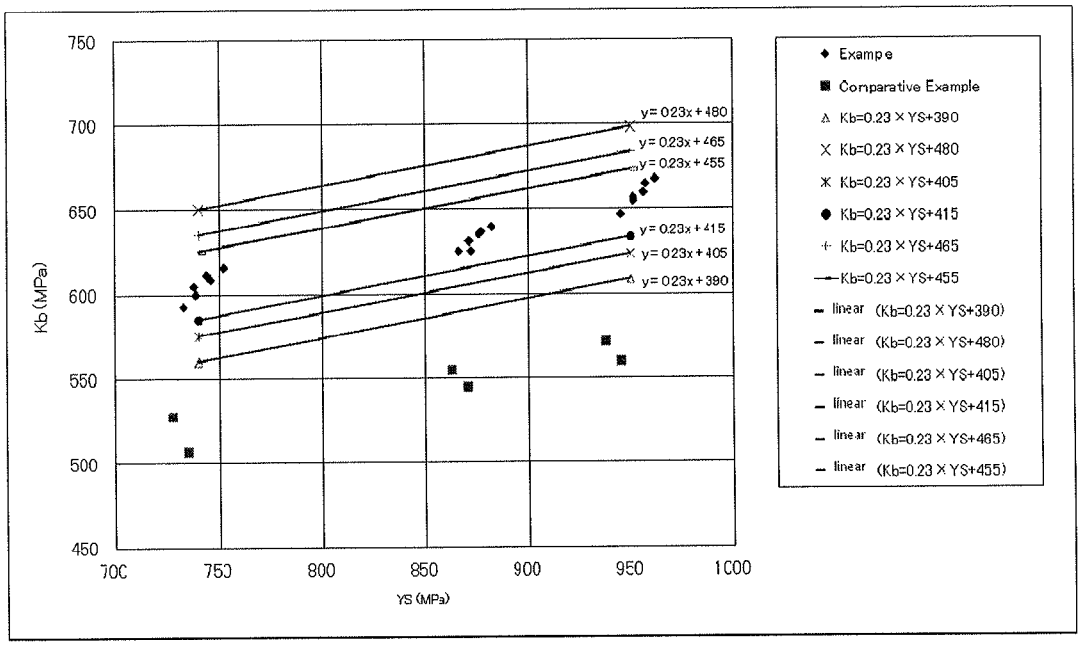
FIG. 1 is a diagram obtained by plotting YS on the x-axis and Kb on the y-axis in relation to Examples No. 127 to 144 and Comparative Examples No. 160 to 165.

1. Amounts of Addition of Ni, Co and Si

Ni, Co and Si form an intermetallic compound when subjected to an appropriate heat treatment, and an increase in strength can be promoted without deteriorating electrical conductivity.

If the amounts of addition of Ni, Co and Si are such that Ni: less than 1.0% by mass, Co: less than 0.5% by mass, and Si: less than 0.3% by mass, respectively, the desired strength may not be obtained. On the other hand, if the amounts of addition are such that Ni: greater than 2.5% by mass, Co: greater than 2.5% by mass, and Si: greater than 1.2% by mass, an increase in strength can be promoted, but electrical conductivity decreases significantly, and hot workability deteriorates. Therefore, the amounts of addition of Ni, Co and Si have been set at 1.0% to 2.5% by mass of Ni, 0.5% to 2.5% by mass of Co, and 0.3% to 1.2% by mass of Si. The amounts of addition of Ni, Co and Si are preferably 1.5% to 2.0% by mass of Ni, 0.5% to 2.0% by mass of Co, and 0.5% to 1.0% by mass of Si.

Furthermore, if the ratio of the total mass concentration of Ni and Co to the mass concentration of Si, [Ni+Co]/Si, is too low, that is, if the ratio of Si to Ni and Co is too high, electrical conductivity may decrease due to solid solution Si, or an oxidation coating of $SiO_2$ may be formed at the material surface layer during an annealing process, causing deterioration of solderability. On the other hand, if the proportion of Ni and Co to Si is too high, Si that is necessary for the formation of silicide is insufficient, and high strength cannot be easily obtained.

Therefore, it is preferable to control the [Ni+Co]/Si ratio in the alloy composition to the range of $4 \leq [Ni+Co]/Si \leq 5$, and it is more preferable to control the ratio to the range of $4.2 \leq [Ni+Co]/Si \leq 4.7$.

2. Amount of Addition of Cr

Since Cr preferentially precipitates out to the crystal grain boundaries during the cooling process at the time of melting and casting, the grain boundaries can be reinforced, cracking does not easily occur during hot working, and a decrease in yield can be suppressed. That is, Cr that has precipitated out to the grain boundaries at the time of melting and casting, forms a solid solution again through a solution heat treatment or the like. However, at the time of subsequent aging and precipitation, Cr produces precipitate particles having a bcc structure containing Cr as a main component, or a compound with Si. In a conventional Cu—Ni—Si alloy, from among the amount of Si added, Si that did not participate in aging and precipitation suppresses an increase in electrical conductivity while still being solid-solubilized in the matrix phase. However, when Cr which is a silicate-forming element is added, and silicate is further precipitated out, the amount of solid solution Si can be reduced, and electrical conductivity can be increased without impairing strength. Nevertheless, if the Cr concentration exceeds 0.5% by mass, coarse second phase particles are likely to be formed, and consequently, the product characteristics are impaired. Therefore, in the Cu—Ni—Si—Co alloy according to the present invention, Cr can be added in an amount of 0.5% by mass at the maximum. However, since the effect is insignificant at an amount of less than 0.03% by mass, it is desirable to add Cr preferably in an amount of 0.03% to 0.5% by mass, and more preferably 0.09% to 0.3% by mass.

3. Amounts of Addition of Mg, Mn, Ag and P

Mg, Mn, Ag and P improve product characteristics such as strength and stress relaxation characteristics, without impairing electrical conductivity, when added even in very small amounts. The effect of addition is exhibited mainly through solid solubilization in the matrix phase, but the effect can be more effectively exhibited by being incorporated into the second phase particles. However, if the total amount of the concentrations of Mg, Mn, Ag and P is greater than 0.5%, the characteristics improving effect is saturated, and manufacturability is impaired. Therefore, in the Cu—Ni—Si—Co alloy according to the present invention, one kind or two or more kinds selected from Mg, Mn, Ag and P can be added in a total amount of 0.5% by mass at the maximum. However, since the effect is insignificant at an amount of less than 0.01% by mass, it is desirable to add the elements preferably in a total amount of 0.01% to 0.5% by mass, and more preferably in a total amount of 0.04% to 0.2% by mass.

4. Amounts of Addition of Sn and Zn

Sn and Zn also improve product characteristics such as strength, stress relaxation characteristics and plating properties, without impairing electrical conductivity, when added even in very small amounts. The effect of addition is exhibited mainly through solid solubilization in the matrix phase. However, if the total amount of Sn and Zn is greater than 2.0% by mass, the characteristics improving effect is saturated, and manufacturability is impaired. Therefore, in the Cu—Ni—Si—Co alloy according to the present invention, one kind or two or more kinds selected from Sn and Zn can be added in a total amount of 2.0% by mass at the maximum. However, since the effect is insignificant at an amount of less than 0.05% by mass, it is desirable to add the elements preferably in a total amount of 0.05% to 2.0% by mass, and more preferably in a total amount of 0.5% to 1.0% by mass.

5. Amounts of Addition of As, Sb, Be, B, Ti, Zr, Al and Fe

As, Sb, Be, B, Ti, Zr, Al and Fe also improve product characteristics such as electrical conductivity, strength, stress relaxation characteristics, and plating properties when the amounts of addition are adjusted in accordance with the required product characteristics. The effect of addition is exhibited mainly through solid solubilization in the matrix phase, but the effect can be exhibited more effectively when the elements are incorporated into the second phase particles or form second phase particles with a new composition. However, if the total amount of these elements is greater than 2.0% by mass, the characteristics improving effect is saturated, and manufacturability is impaired. Therefore, in the Cu—Ni—Si—Co alloy according to the present invention, one kind or two or more kinds selected from As, Sb, Be, B, Ti, Zr, Al and Fe can be added in a total amount of 2.0% by mass at the maximum. However, since the effect is insignificant at an amount of less than 0.001% by mass, it is desirable to add the elements preferably in a total amount of 0.001% to 2.0% by mass, and more preferably in a total amount of 0.05% to 1.0% by mass.

If the amounts of addition of Mg, Mn, Ag, P, Sn, Zn, As, Sb, Be, B, Ti, Zr, Al and Fe described above are exceed 3.0% by mass in total, manufacturability is likely to be impaired. Therefore, the total amount of these elements is adjusted preferably to 2.0% by mass or less, and more preferably to 1.5% by mass or less.

6. Crystal Orientation

The copper alloy according to the present invention is such that from the results obtainable by an X-ray diffraction pole figure analysis using a rolled surface as a base, among the diffraction peak intensities of the {111}Cu plane with respect to the {200}Cu plane obtained by β scanning at α=35°, the ratio of the peak height at a β angle of 90° of the copper alloy to the peak height of a standard copper powder (hereinafter, referred to as "peak height ratio at a β angle of 90°") is at least 2.5 times. The reason why spring bending elastic limit is increased by controlling the peak height at a β angle of 90° among the diffraction peaks of the {111}Cu plane is not necessarily clearly known, and although it is an assumption to the last, it is speculated that when the first aging treatment is carried out by three-stage aging, due to the growth of second phase particles precipitated out in the first and second stages and the second phase particles precipitated out in the third stage, the working strain is likely to be accumulated during rolling in a subsequent process, and the texture is developed during a second aging treatment as the accumulated working strain functions as the driving force.

The peak height ratio at a β angle of 90° is preferably at least 2.8 times, and more preferably at least 3.0 times. A standard pure copper powder is defined as a copper powder with a purity of 99.5% having a size of 325 mesh (JIS Z8801).

The peak height at a β angle of 90° among the diffraction peaks of the {111}Cu plane is measured by the following procedure. A measurement method of selecting a certain diffraction plane {hkl}Cu, performing stepwise α-axis scanning for the 2θ values of the selected {hkl}Cu plane (by fixing the scanning angle 2θ of the detector), and subjecting the sample to β-axis scanning (in-plane rotation (spin) from 0° C. to 360° C.) for various α values, is referred to as pole figure measurement. Meanwhile, in the XRD pole figure analysis of the present invention, the perpendicular direction relative to the sample surface is defined as α90° and is used as the reference of measurement. Also, the pole figure measurement is carried out by a reflection method (α: −15° to 90°). In the present invention, the intensity of α=35° is plotted against the β angle, and the peak value at β=90° is read.

7. Characteristics

According to an embodiment, the copper alloy related to the present invention can satisfy the following formulas:

$$-14.6\times(\text{Ni concentration}+\text{Co concentration})^2+165\times(\text{Ni concentration}+\text{Co concentration})+544\geq YS\geq-14.6\times(\text{Ni concentration}+\text{Co concentration})^2+165\times(\text{Ni concentration}+\text{Co concentration})+512.3, \quad \text{Formula A:}$$

and $$20\times(\text{Ni concentration}+\text{Co concentration})+625\geq Kb\geq 20\times(\text{Ni concentration}+\text{Co concentration})+520 \quad \text{Formula B:}$$

wherein the unit of the Ni concentration and the Co concentration is percent (%) by mass; YS represents 0.2% yield strength; and Kb represents spring bending elastic limit.

According to a preferred embodiment, the copper alloy related to the present invention can satisfy the following formulas:

$$-14.6\times(\text{Ni concentration}+\text{Co concentration})^2+165\times(\text{Ni concentration}+\text{Co concentration})+541\geq YS\geq-14.6\times(\text{Ni concentration}+\text{Co concentration})^2+165\times(\text{Ni concentration}+\text{Co concentration})+518.3, \quad \text{Formula A':}$$

and $$20\times(\text{Ni concentration}+\text{Co concentration})+610\geq Kb\geq 20\times(\text{Ni concentration}+\text{Co concentration})+540; \quad \text{Formula B':}$$

and more preferably, $$-14.6\times(\text{Ni concentration}+\text{Co concentration})^2+165\times(\text{Ni concentration}+\text{Co concentration})+538\geq YS\geq-14.6\times(\text{Ni concentration}+\text{Co concentration})^2+165\times(\text{Ni concentration}+\text{Co concentration})+523, \quad \text{Formula A'':}$$

and $$20\times(\text{Ni concentration}+\text{Co concentration})+595\geq Kb\geq 20\times(\text{Ni concentration}+\text{Co concentration})+555 \quad \text{Formula B'':}$$

wherein the unit of the Ni concentration and the Co concentration is percent (%) by mass; YS represents 0.2% yield strength; and Kb represents spring bending elastic limit.

According to an embodiment, the copper alloy related to the present invention is such that the relationship between Kb and YS can satisfy the following formula:

$$0.23\times YS+480\geq Kb\geq 0.23\times YS+390 \quad \text{Formula C:}$$

wherein YS represents 0.2% yield strength; and Kb represents spring bending elastic limit.

According to a preferred embodiment, the copper alloy related to the present invention is such that the relationship between Kb and YS can satisfy the following formula:

$$0.23\times YS+465\geq Kb\geq 0.23\times YS+405; \quad \text{Formula C':}$$

and more preferably, $$0.23\times YS+455\geq Kb\geq 0.23\times YS+415 \quad \text{Formula C'':}$$

wherein YS represents 0.2% yield strength; and Kb represents spring bending elastic limit.

8. Distribution Conditions for Second Phase Particles

According to the present invention, the second phase particles primarily refer to silicide but are not intended to be limited thereto, and the second phase particles include the crystals generated in the solidification process of melting and casting and the precipitate generated in the subsequent cooling process, the precipitate generated in the cooling process after hot rolling, the precipitate generated in the cooling process after a solution heat treatment, and the precipitate generated in the aging treatment process.

In the Cu—Ni—Si—Co alloy according to the present invention, the distribution of the second phase particles having a particle size of from 0.1 μm to 1 μm is kept under control. The second phase particles having a particle size in this range do not have so much effect in an enhancement of strength, but are useful for increasing spring bending elastic limit.

In order to enhance both strength and spring bending elastic limit, it is desirable to adjust the number density of the second phase particles having a particle size of from 0.1 μm to 1 μm to $5\times10^5$ to $1\times10^7$ particles/mm$^2$, preferably to $1\times10^6$ to $10\times10^6$ particles/mm$^2$, and more preferably to $5\times10^6$ to $10\times10^6$ particles/mm$^2$.

According to the present invention, the particle size of the second phase particles refers to the diameter of the smallest circle that circumscribes a second phase particle observed under the conditions described below.

The number density of the second phase particles having a particle size of from 0.1 μm to 1 μm can be observed by using an electron microscope which is capable of observing particles at a high magnification (for example, 3000 times), such as FE-EPMA or FE-SEM, and an image analysis software in combination, and measurement of the number or the particle size can be carried out. For the preparation of a sample material, the second phase particles may be exposed by etching the matrix phase according to general electrolytic polishing conditions under which the particles that precipitate out with the composition of the present invention would not dissolve. There is no limitation on whether the surface to be observed should be a rolled surface or a cross-section of the sample material.

9. Production Method

In a general production process for Corson copper alloys, first, the aforementioned raw materials such as electrolytic copper, Ni, Si and Co are melted by using an atmospheric melting furnace, and thus a molten metal having a desired composition is obtained. This molten metal is cast into an ingot. Subsequently, the ingot is subjected to hot rolling, and repeatedly to cold rolling and heat treatments, and thus a strip or a foil having a desired thickness and desired characteristics is obtained. The heat treatments include a solution heat treatment and an aging treatment. The solution heat treatment involves heating at a high temperature of about 700° C. to about 1000° C., solid solubilization of second phase particles in the Cu matrix, and simultaneous recrystallization of the Cu matrix. The solution heat treatment may also be carried out together with hot rolling. The aging treatment involves heating for one hour or longer at a temperature in the range of about 350° C. to about 550° C., and precipitation of second phase particles that have been solid-solubilized through the solution heat treatment, into fine particles having a size in the order of nanometers. This aging treatment causes an increase in strength and electrical conductivity. In order to obtain higher strength, cold rolling may be carried out before aging and/or after aging. Furthermore, in the case of conducting cold rolling after aging, stress relief annealing (low temperature annealing) may be carried out after cold rolling.

Between the various processes described above, grinding, polishing, shot blasting, acid pickling and the like are appropriately carried out in order to remove oxidized scale at the surface.

The copper alloy according to the present invention is also subjected to the production processes described above, but in order for the characteristics of the copper alloy that are finally obtained to be in the scope defined in the present invention, it is critical to carry out the production processes while strictly controlling the conditions for hot rolling, solution heat treatment and aging treatment. It is because, unlike the conventional Cu—Ni—Si Corson system alloys, in the Cu—Ni—Co—Si alloy of the present invention, Co (in some cases, Cr as well) which makes the control of second phase particles difficult is purposefully added as an essential component for aging precipitation hardening. It is because Co forms second phase particles together with Ni or Si, and the rate of production and growth of those second phase particles is sensitive to the retention temperature at the time of heat treatment and the cooling rate.

First, since coarse crystals are inevitably produced in the solidification process at the time of casting, and coarse precipitates are inevitably produced in the cooling process at the time of casting, it is necessary to form a solid solution of these second phase particles in the matrix phase in the subsequent processes. When hot rolling is conducted after maintaining the system for one hour or longer at 950° C. to 1050° C., and the temperature at the time of completion of hot rolling is adjusted to 850° C. or higher, even if Co, and even Cr, has been added, the second phase particles can form a solid solution in the matrix phase. The temperature condition of 950° C. or higher is a higher temperature condition as compared with the case of other Corson system alloys. If the retention temperature before hot rolling is lower than 950° C., solid solution occurs insufficiently, and if the retention temperature is higher than 1050° C., there is a possibility that the material may melt. Furthermore, if the temperature at the time of completion of hot rolling is lower than 850° C., since the elements that have been solid-solubilized precipitate out again, it is difficult to obtain high strength. Therefore, in order to obtain high strength, it is desirable to complete hot rolling at a temperature of 850° C. or higher, and perform cooling rapidly.

Specifically, it is desirable to set the cooling rate in the period in which the material temperature falls from 850° C. to 400° C. after hot rolling, to 15° C./s or greater, preferably 18° C./s or greater, for example, to 15° C. to 25° C./s, and typically to 15° C. to 20° C./s. In the present invention, the "average cooling rate from 850° C. to 400° C." after hot rolling refers to the value (° C./s) obtained by measuring the time taken for the material temperature to fall from 850° C. to 400° C., and calculating the value by the formula:

"(850−400)(° C.)/cooling time(s)".

The purpose of the solution heat treatment is to form a solid solution of the crystal particles at the time of melting and casting, or of the precipitate particles after hot rolling, and increasing the aging hardenability after the solution heat treatment. At this time, in order to control the number density of the second phase particles, the retention temperature and time at the time of the solution heat treatment, and the cooling rate after the retention become critical. In the case where the retention time is constant, by elevating the retention temperature, the crystal particles formed at the time of melting and casting, or the precipitate particles formed after hot rolling can be solid-solubilized, and the area ratio can be reduced.

A faster cooling rate after the solution heat treatment can suppress precipitation during cooling more effectively. If the cooling rate is too slow, the second phase particles become coarse during cooling, and the contents of Ni, Co and Si in the second phase particles increase. Therefore, sufficient solid solution cannot be formed by the solution heat treatment, and the aging hardenability can be decreased. Accordingly, the cooling after the solution heat treatment is preferably carried out by rapid cooling. Specifically, after a solution heat treatment at 850° C. to 1050° C., it is effective to perform cooling to 400° C. at an average cooling rate of 10° C. or more per second, preferably 15° C. or more per second, and more preferably 20° C. or more per second. However, on the contrary, if the average cooling rate is increased too high, a strength increasing effect may not be sufficiently obtained. Therefore, the cooling rate is preferably 30° C. or less per second, and more preferably 25° C. or less per second. Here, the "average cooling rate" refers to the value (° C./sec) obtained by measuring the cooling time taken from the solution heat treatment temperature to 400° C., and calculating the value by the formula:

"(solution heat treatment temperature−400)(° C.)/cooling time(seconds)"

With regard to the cooling conditions after the solution heat treatment, it is more preferable to set the second stage cooling conditions as described in Patent Literature 1. That is, after the solution heat treatment, it is desirable to employ two-stage cooling in which mild cooling is carried out over the range of from 850° C. to 650° C., and thereafter, rapid cooling is carried out over the range of from 650° C. to 400° C. Thereby, spring bending elastic limit is further enhanced.

Specifically, after the solution heat treatment at 850° C. to 1050° C., the average cooling rate at which the material temperature falls from the solution heat treatment temperature to 650° C. is controlled to higher than or equal to 1° C./s and lower than 15° C./s, and preferably from 5° C./s to 12° C./s, and the average cooling rate employed when the material temperature falls from 650° C. to 400° C. is controlled to 15° C./s or higher, preferably 18° C./s or higher, for example, 15° C. to 25° C./s, and typically 15° C. to 20° C./s. Meanwhile, since precipitation of the second phase particles occurs significantly up to about 400° C., the cooling rate at a temperature of lower than 400° C. does not matter.

In regard to the control of the cooling rate after the solution heat treatment, the cooling rate can be adjusted by providing a slow cooling zone and a cooling zone adjacently to the heating zone that has been heated in the range of 850° C. to 1050° C., and adjusting the retention time for the respective zones. In the case where rapid cooling is needed, water cooling may be carried out as the cooling method, and in the case of mild cooling, a temperature gradient may be provided inside the furnace.

The "average cooling rate (at which the temperature) falls to 650° C." after the solution heat treatment refers to the value (° C./s) obtained by measuring the cooling time taken for the temperature to fall from the material temperature maintained in the solution heat treatment to 650° C., and calculating the value by the formula: "(solution heat treatment temperature−650) (° C.)/cooling time (s)". The "average cooling rate (for the temperature) to fall from 650° C. to 400° C." similarly means the value (° C./s) calculated by the formula:

"(650−400)(° C.)/cooling time(s)".

If only the cooling rate after the solution heat treatment is controlled without managing the cooling rate after hot rolling, coarse second phase particles cannot be sufficiently suppressed by a subsequent aging treatment. The cooling rate after hot rolling and the cooling rate after the solution heat treatment all need to be controlled.

Regarding a method of performing cooling rapidly, water cooling is most effective. However, since the cooling rate changes with the temperature of water used in water cooling, cooling can be achieved more rapidly by managing the water temperature. If the water temperature is 25° C. or higher, the desired cooling rate may not be obtained in some cases, and thus it is preferable to maintain the water temperature at 25° C. or lower. When the material is water-cooled by placing the material in a tank in which water is collected, the temperature of water is likely to increase to 25° C. or higher. Therefore, it is preferable to prevent an increase in the water temperature, so that the material would be cooled to a certain water temperature (25° C. or lower), by spraying water in a spray form (in a shower form or a mist form), or causing cold water to flow constantly to the water tank. Furthermore, the cooling rate can be increased by extending the number of water cooling nozzles or by increasing the amount of water per unit time.

In the production of the Cu—Ni—Co—Si alloy according to the present invention, it is effective to perform an aging treatment to a slight degree in two divided stages after the solution heat treatment, and to perform cold rolling during the two rounds of aging treatment. Thereby, coarsening of the precipitate is suppressed, and a satisfactory distribution state of the second phase particles can be obtained.

In Patent Literature 1, the first aging treatment is carried out by selecting a temperature slightly lower than the conditions that are considered useful for the micronization of the precipitate and are conventionally carried out, and it is considered that while the precipitation of fine second phase particles is accelerated, coarsening of the precipitate that has a potential to be precipitated by a second solution heat treatment, is prevented. Specifically, the first aging treatment is set to be carried out for 1 to 24 hours at a temperature in the range of higher than or equal to 425° C. and lower than 475° C. However, the inventors of the present invention found that when the first aging treatment immediately after the solution heat treatment is carried out by three-stage aging under the following specific conditions, spring bending elastic limit remarkably increases. There have been documents which describe that a balance between strength and electric conductivity is enhanced by conducting multistage aging; however, surprisingly it was found that when the number of stages, temperature, time, and cooling rate of multistage aging are strictly controlled, even spring bending elastic limit is markedly enhanced. According to the experiment of the inventors of the present invention, such effects cannot be obtained by single-stage aging or two-stage aging, and if only the second aging treatment is carried out by three-stage aging, a sufficient effect was not obtained.

It is not intended to limit the present invention by theory, but the reason why spring bending elastic limit is markedly enhanced by employing three-stage aging is considered to be as follows. When the first aging treatment is carried out by three-stage aging, due to the growth of second phase particles precipitated in the first and second stages and the second phase particles precipitated out in the third stage, the working strain is likely to be accumulated during rolling in a subsequent process, and the texture is developed during a second aging treatment as the accumulated working strain functions as the driving force.

Regarding the three-stage aging, first, a first stage is carried out by heating the material for 1 to 12 hours by setting the material temperature to 400° C. to 500° C., preferably heating the material for 2 to 10 hours by setting the material temperature to 420° C. to 480° C., and more preferably heating the material for 3 to 8 hours by setting the material temperature to 440° C. to 460° C. In the first stage, it is intended to increase strength and electrical conductivity by nucleation and growth of the second phase particles.

If the material temperature is lower than 400° C. or the heating time is less than one hour in the first stage, the volume fraction of the second phase particles is small, and desired strength and electrical conductivity cannot be easily obtained. On the other hand, if heating has been carried out until the material temperature reaches above 500° C., or if the heating time has exceeded 12 hours, the volume fraction of the second phase particles increases, but the particles become coarse, so that the strength strongly tends to decrease.

After completion of the first stage, the temperature of the aging treatment is changed to the aging temperature of the second stage at a cooling rate of 1° C. to 8° C./min, preferably 3° C. to 8° C./min, and more preferably 6° C. to 8° C./min. The cooling rate is set to such a cooling rate for the reason that the second phase particles precipitated out in the first stage should not be excessively grown. The cooling rate as used herein is measured by the formula:

(first stage aging temperature−second stage aging treatment)(° C.)/(cooling time (minutes) taken for the aging temperature to reach from the first stage aging temperature to the second stage aging temperature).

Subsequently, the second stage is carried out by heating the material for 1 to 12 hours by setting the material temperature to 350° C. to 450° C., preferably heating the material for 2 to 10 hours by setting the material temperature to 380° C. to 430° C., and more preferably heating the material for 3 to 8 hours by setting the material temperature to 400° C. to 420° C. In the second stage, it is intended to increase electrical conductivity by growing the second phase particles precipitated out in the first stage to the extent that contributes to strength, and to increase strength and electrical conductivity by precipitating fresh second phase particles in the second stage (smaller than the second phase particles precipitated in the first stage).

If the material temperature is lower than 350° C. or the heating time is less than one hour in the second stage, since the second phase particles precipitated out in the first stage cannot be grown, it is difficult to increase electrical conductivity, and since fresh second phase particles cannot be precipitated out in the second stage, strength and electrical conductivity cannot be increased. On the other hand, if heating has been carried out until the material temperature reaches above 450° C., or if the heating time has exceeded 12 hours, the second phase particles that have precipitated out in the first stage grow excessively and become coarse, or strength decreases.

If the temperature difference between the first stage and the second stage is too small, the second phase particles that have precipitated out in the first stage become coarse, causing a decrease in strength. On the other hand, if the temperature difference is too large, the second phase particles that have precipitated out in the first stage hardly grow, and electrical conductivity cannot be increased. Furthermore, since it is difficult for the second phase particles to precipitate out in the second phase, strength and electrical conductivity cannot be increased. Therefore, the temperature difference between the first stage and the second stage should be adjusted to 20° C. to 60° C., preferably to 20° C. to 50° C., and more preferably to 20° C. to 40° C.

For the same reason described above, after completion of the second stage, the temperature of the aging treatment is changed to the aging temperature of the third stage at a cooling rate of 1° C. to 8° C./min, preferably 3° C. to 8° C./min, and more preferably 6° C. to 8° C./min. The cooling rate as used herein is measured by the formula:

(second stage aging temperature−third stage aging treatment)(° C.)/(cooling time (minutes) taken for the aging temperature to reach from the second stage aging temperature to the third stage aging temperature).

Subsequently, the third stage is carried out by heating the material for 4 to 30 hours by setting the material temperature to 260° C. to 340° C., preferably heating the material for 6 to 25 hours by setting the material temperature to 290° C. to 330° C., and more preferably heating the material for 8 to 20 hours by setting the material temperature to 300° C. to 320° C. In the third stage, it is intended to slightly grow the second phase particles that have precipitated out in the first stage and the second stage, and to produce fresh second phase particles.

If the material temperature is lower than 260° C. or the heating time is less than 4 hours in the third stage, the second phase particles that have precipitated out in the first stage and the second stage cannot be grown, and fresh second phase particles cannot be produced. Therefore, it is difficult to obtain desired strength, electrical conductivity and spring bending elastic limit. On the other hand, if heating has been carried out until the material temperature reaches above 340° C., or if the heating time has exceeded 30 hours, the second phase particles that have precipitated out in the first stage and the second stage grow excessively and become coarse, and therefore, it is difficult to obtain desired strength and spring bending elastic limit.

If the temperature difference between the second stage and the third stage is too small, the second phase particles that have precipitated out in the first stage and second stage become coarse, causing a decrease in strength and spring bending elastic limit. On the other hand, if the temperature difference is too large, the second phase particles that have precipitated out in the first stage and the second stage hardly grow, and electrical conductivity cannot be increased. Furthermore, since it is difficult for the second phase particles to precipitate out in the third stage, strength, spring bending elastic limit and electrical conductivity cannot be increased. Therefore, the temperature difference between the second stage and the third stage should be adjusted to 20° C. to 180° C., preferably to 50° C. to 135° C., and more preferably to 70° C. to 120° C.

In each stage of aging treatment, since the distribution of the second phase particles undergoes change, the temperature is in principle maintained constant; however, it does not matter even if there is a fluctuation of about ±5° C. relative to the set temperature. Thus, the respective steps are carried out with a temperature deviation width of 10° C. or less.

After the first aging treatment, cold rolling is carried out. In this cold rolling, insufficient aging hardening achieved by the first aging treatment can be supplemented by work hardening. The degree of working at this time is 10% to 80%, and preferably 20% to 60%, in order to reach a desired strength level. However, spring bending elastic limit decreases. Furthermore, the particles having a particle size of less than 0.01 μm that have precipitated out by the first aging treatment are sheared by dislocations and are solid-solubilized again, and electrical conductivity decreases.

After the cold rolling, it is important to increase spring bending elastic limit and electrical conductivity by a second aging treatment. When the second aging temperature is set to a high value, spring bending elastic limit and electrical conductivity are increased. However, if the temperature condition is too high, particles having a particle size of from 0.1 μm to 1 μm that have already precipitated out become coarse, the material reaches an over-aged state, and strength decreases. Therefore, it should be noted that in the second aging treatment, the material is retained for a long time at a temperature lower than the conditions that are conventionally employed, in order to promote the recovery of electrical conductivity and spring bending elastic limit. This is because the effects of suppression of the rate of precipitation of an alloy system containing Co and rearrangement of dislocations are all increased. An example of the conditions for the second aging treatment is 1 to 48 hours at a temperature in the range of higher than or equal to 100° C. and lower than 350° C., and more preferably 1 to 12 hours at a temperature in the range of from 200° C. to 300° C.

Immediately after the second aging treatment, even in the case where the aging treatment has been carried out in an inert gas atmosphere, the surface is slightly oxidized, and solder wettability is poor. Thus, in the case where solder wettability is required, acid pickling and/or polishing can be carried out. Regarding the method of acid pickling, any known technique may be used, and for example, a method of immersing the alloy material in an acid mixture (acid prepared by mixing water with sulfuric acid, aqueous hydrogen peroxide, and water) may be used. Regarding the method of polishing, any known technique may be used, and for example, a method based on buff polishing may be used.

Meanwhile, even if acid pickling or polishing is carried out, the peak height ratio at β angle of 90°, 0.2% yield strength YS, and electrical conductivity EC are hardly affected, but spring bending elastic limit Kb decreases.

The Cu—Ni—Si—Co alloy of the present invention can be processed into various wrought copper products, for example, sheets, strips, tubes, rods and wires. Furthermore, the Cu—Ni—Si—Co system copper alloy according to the present invention can be used in electronic components such as lead frames, connectors, pins, terminals, relays, switches, and foils for secondary batteries.

Examples

Hereinafter, Examples of the present invention will be described together with Comparative Examples. However, these Examples are provided to help better understanding of the present invention and its advantages, and are not intended to limit the present invention by any means.

Influence of First Aging Conditions on Alloy Characteristics

A copper alloy containing the various additive elements indicated in Table 1, with the balance being copper and impurities, was melted at 1300° C. in a high frequency melting furnace, and the copper alloy was cast into an ingot having a thickness of 30 mm. Subsequently, this ingot was heated for 3 hours at 1000° C., and then was hot rolled at a finish temperature (hot rolling completion temperature) of 900° C. to obtain a plate thickness of 10 mm. After completion of the hot rolling, the resultant was cooled rapidly to 400° C. at a cooling rate of 15° C./s. Subsequently, the resultant was left to stand in air to cool. Subsequently, the resultant was subjected to surface grinding to a thickness of 9 mm in order to remove scale at the surface, and then was processed into a plate having a thickness of 0.13 mm by cold rolling. Subsequently, a solution heat treatment was carried out at 950° C. for 120 seconds, and thereafter, the resultant was cooled. The cooling conditions were such that in Examples No. 1 to 126 and Comparative Examples No. 1 to 159, water cooling was carried out from the solution heat treatment temperature to 400° C. at an average cooling rate of 20° C./s; and in Examples No. 127 to 144 and Comparative Examples No. 160 to 165, the cooling rate employed to drop the temperature from the solution heat treatment temperature to 650° C. was set at 5° C./s, and the average cooling rate employed to drop the temperature from 650° C. to 400° C. was set at 18° C./s. Thereafter, the material was cooled by leaving the material to stand in air. Subsequently, the first aging treatment was applied under the various conditions indicated in Table 1 in an inert atmosphere. The material temperature in the respective stages was maintained within ±3° C. from the set temperature indicated in Table 1. Thereafter, cold rolling was carried out to obtain a thickness of 0.08 mm, and finally, a second aging treatment was carried out for 3 hours at 300° C. in an inert atmosphere, and thus each of the specimens was produced. After the second aging treatment, acid pickling with a mixed acid, and a polishing treatment using buff were carried out.

TABLE 1

| | Composition (mass %) | | | | | | First aging treatment | | | | | | | |
|---|---|---|---|---|---|---|---|---|---|---|---|---|---|---|
| | Ni | Co | Si | Cr | Others | Ni + Co | First stage temperature (° C.) | First stage → second stage cooling rate (° C./min) | Second stage temperature (° C.) | Second stage → third stage cooling rate (° C./min) | Third stage temperature (° C.) | First stage time (hr) | Second stage time (hr) | Third stage time (hr) |
| No. Example | | | | | | | | | | | | | | |
| 1 | 1.8 | 1.0 | 0.65 | — | — | 2.8 | 400 | 6 | 360 | 6 | 330 | 6 | 12 | 6 |
| 2 | | | | | | | | | | | | 6 | 12 | 10 |
| 3 | | | | | | | | | | | | 6 | 12 | 15 |
| 4 | | | | | | | | | | | | 12 | 6 | 6 |
| 5 | | | | | | | | | | | | 12 | 6 | 10 |
| 6 | | | | | | | | | | | | 12 | 6 | 15 |
| 7 | | | | | | | | | | | | 12 | 12 | 6 |
| 8 | | | | | | | | | | | | 12 | 12 | 10 |
| 9 | | | | | | | | | | | | 12 | 12 | 15 |
| 10 | | | | | | | 460 | | 420 | | 270 | 3 | 6 | 15 |
| 11 | | | | | | | | | | | | 3 | 6 | 25 |
| 12 | | | | | | | | | | | | 3 | 6 | 30 |
| 13 | | | | | | | | | | | | 6 | 6 | 15 |
| 14 | | | | | | | | | | | | 6 | 6 | 25 |
| 15 | | | | | | | | | | | | 6 | 6 | 30 |
| 16 | | | | | | | | | | | | 6 | 12 | 15 |
| 17 | | | | | | | | | | | | 6 | 12 | 25 |
| 18 | | | | | | | | | | | | 6 | 12 | 30 |
| 19 | | | | | | | 460 | | 420 | | 300 | 3 | 6 | 15 |
| 20 | | | | | | | | | | | | 3 | 6 | 10 |
| 21 | | | | | | | | | | | | 3 | 6 | 6 |
| 22 | | | | | | | | | | | | 6 | 6 | 6 |
| 23 | | | | | | | | | | | | 6 | 6 | 10 |
| 24 | | | | | | | | | | | | 6 | 6 | 15 |
| 25 | | | | | | | | | | | | 6 | 12 | 6 |
| 26 | | | | | | | | | | | | 6 | 12 | 10 |
| 27 | | | | | | | | | | | | 6 | 12 | 15 |
| 28 | | | | | | | 460 | | 420 | | 330 | 3 | 6 | 4 |
| 29 | | | | | | | | | | | | 3 | 6 | 6 |
| 30 | | | | | | | | | | | | 3 | 6 | 10 |

TABLE 1-continued

| | | | | | | | | | | | | | | |
|---|---|---|---|---|---|---|---|---|---|---|---|---|---|---|
| 31 | | | | | | | | | | | | 6 | 6 | 4 |
| 32 | | | | | | | | | | | | 6 | 6 | 6 |
| 33 | | | | | | | | | | | | 6 | 6 | 10 |
| 34 | | | | | | | | | | | | 6 | 12 | 4 |
| 35 | | | | | | | | | | | | 6 | 12 | 6 |
| 36 | | | | | | | | | | | | 6 | 12 | 10 |
| 37 | | | | | | | 500 | | 450 | | 270 | 1 | 3 | 15 |
| 38 | | | | | | | | | | | | 1 | 3 | 25 |
| 39 | | | | | | | | | | | | 1 | 3 | 30 |
| 40 | | | | | | | | | | | | 1 | 6 | 15 |
| 41 | | | | | | | | | | | | 1 | 6 | 25 |
| 42 | | | | | | | | | | | | 1 | 6 | 30 |
| 43 | | | | | | | | | | | | 3 | 3 | 15 |
| 44 | | | | | | | | | | | | 3 | 3 | 25 |
| 45 | | | | | | | | | | | | 3 | 3 | 30 |
| 46 | 1.8 | 1.0 | 0.65 | 0.1 | — | 2.8 | 400 | 6 | 360 | 6 | 330 | 6 | 12 | 6 |
| 47 | | | | | | | | | | | | 6 | 12 | 10 |
| 48 | | | | | | | | | | | | 6 | 12 | 15 |
| 49 | | | | | | | | | | | | 12 | 6 | 6 |
| 50 | | | | | | | | | | | | 12 | 6 | 10 |
| 51 | | | | | | | | | | | | 12 | 6 | 15 |
| 52 | | | | | | | | | | | | 12 | 12 | 6 |
| 53 | | | | | | | | | | | | 12 | 12 | 10 |
| 54 | | | | | | | | | | | | 12 | 12 | 15 |
| 55 | | | | | | | 460 | | 420 | | 270 | 3 | 6 | 15 |
| 56 | | | | | | | | | | | | 3 | 6 | 25 |
| 57 | | | | | | | | | | | | 3 | 6 | 30 |
| 58 | | | | | | | | | | | | 6 | 6 | 15 |
| 59 | | | | | | | | | | | | 6 | 6 | 25 |
| 60 | | | | | | | | | | | | 6 | 6 | 30 |
| 61 | | | | | | | | | | | | 6 | 12 | 15 |
| 62 | | | | | | | | | | | | 6 | 12 | 25 |
| 63 | | | | | | | | | | | | 6 | 12 | 30 |
| 64 | | | | | | | 460 | | 420 | | 300 | 3 | 6 | 15 |
| 65 | | | | | | | | | | | | 3 | 6 | 10 |
| 66 | | | | | | | | | | | | 3 | 6 | 6 |
| 67 | | | | | | | | | | | | 6 | 6 | 6 |
| 68 | | | | | | | | | | | | 6 | 6 | 10 |
| 69 | | | | | | | | | | | | 6 | 6 | 15 |
| 70 | | | | | | | | | | | | 6 | 12 | 6 |
| 71 | | | | | | | | | | | | 6 | 12 | 10 |
| 72 | | | | | | | | | | | | 6 | 12 | 15 |
| 73 | | | | | | | 460 | | 420 | | 330 | 3 | 6 | 4 |
| 74 | | | | | | | | | | | | 3 | 6 | 6 |
| 75 | | | | | | | | | | | | 3 | 6 | 10 |
| 76 | | | | | | | | | | | | 6 | 6 | 4 |
| 77 | | | | | | | | | | | | 6 | 6 | 6 |
| 78 | | | | | | | | | | | | 6 | 6 | 10 |
| 79 | | | | | | | | | | | | 6 | 12 | 4 |
| 80 | | | | | | | | | | | | 6 | 12 | 6 |
| 81 | | | | | | | | | | | | 6 | 12 | 10 |
| 82 | | | | | | | 500 | | 450 | | 270 | 1 | 3 | 15 |
| 83 | | | | | | | | | | | | 1 | 3 | 25 |
| 84 | | | | | | | | | | | | 1 | 3 | 30 |
| 85 | | | | | | | | | | | | 1 | 6 | 15 |
| 86 | | | | | | | | | | | | 1 | 6 | 25 |
| 87 | | | | | | | | | | | | 1 | 6 | 30 |
| 88 | | | | | | | | | | | | 3 | 3 | 15 |
| 89 | | | | | | | | | | | | 3 | 3 | 25 |
| 90 | | | | | | | | | | | | 3 | 3 | 30 |
| 91 | 1 | 0.5 | 0.34 | — | — | 1.5 | 460 | 6 | 420 | 6 | 300 | 3 | 6 | 6 |
| 92 | | | | | | | | | | | | 3 | 6 | 10 |
| 93 | | | | | | | | | | | | 3 | 6 | 15 |
| 94 | 2.5 | 1.5 | 0.91 | — | — | 4 | 460 | | 420 | | 300 | 3 | 6 | 6 |
| 95 | | | | | | | | | | | | 3 | 6 | 10 |
| 96 | | | | | | | | | | | | 3 | 6 | 15 |
| 97 | 1 | 0.5 | 0.34 | 0.1 | — | 1.5 | 460 | | 420 | | 300 | 3 | 6 | 6 |
| 98 | | | | | | | | | | | | 3 | 6 | 10 |
| 99 | | | | | | | | | | | | 3 | 6 | 15 |
| 100 | 2.5 | 1.5 | 0.91 | 0.1 | — | 4 | 460 | | 420 | | 300 | 3 | 6 | 6 |
| 101 | | | | | | | | | | | | 3 | 6 | 10 |
| 102 | | | | | | | | | | | | 3 | 6 | 15 |
| 103 | 1.8 | 1.0 | 0.65 | — | 0.5 Sn | 2.8 | 460 | | 420 | | 300 | 3 | 6 | 6 |
| 104 | | | | | | | | | | | | 3 | 6 | 10 |
| 105 | | | | | | | | | | | | 3 | 6 | 15 |
| 106 | 1.8 | 1.0 | 0.65 | — | 0.5 Zn | 2.8 | 460 | | 420 | | 300 | 3 | 6 | 6 |
| 107 | | | | | | | | | | | | 3 | 6 | 10 |
| 108 | | | | | | | | | | | | 3 | 6 | 15 |
| 109 | 1.8 | 1.0 | 0.65 | — | 0.1 Ag | 2.8 | 460 | | 420 | | 300 | 3 | 6 | 6 |
| 110 | | | | | | | | | | | | 3 | 6 | 10 |

TABLE 1-continued

| | | | | | | | | | | | | | | |
|---|---|---|---|---|---|---|---|---|---|---|---|---|---|---|
| 111 | | | | | | | | | | | | 3 | 6 | 15 |
| 112 | 1.8 | 1.0 | 0.65 | — | 0.1 Mg | 2.8 | 460 | | 420 | | 300 | 3 | 6 | 6 |
| 113 | | | | | | | | | | | | 3 | 6 | 10 |
| 114 | | | | | | | | | | | | 3 | 6 | 15 |
| 115 | 1.8 | 1.0 | 0.65 | 0.1 | 0.5 Sn | 2.8 | 460 | | 420 | | 300 | 3 | 6 | 6 |
| 116 | | | | | | | | | | | | 3 | 6 | 10 |
| 117 | | | | | | | | | | | | 3 | 6 | 15 |
| 118 | 1.8 | 1.0 | 0.65 | 0.1 | 0.5 Zn | 2.8 | 460 | | 420 | | 300 | 3 | 6 | 6 |
| 119 | | | | | | | | | | | | 3 | 6 | 10 |
| 120 | | | | | | | | | | | | 3 | 6 | 15 |
| 121 | 1.8 | 1.0 | 0.65 | 0.1 | 0.1 Ag | 2.8 | 460 | | 420 | | 300 | 3 | 6 | 6 |
| 122 | | | | | | | | | | | | 3 | 6 | 10 |
| 123 | | | | | | | | | | | | 3 | 6 | 15 |
| 124 | 1.8 | 1.0 | 0.65 | 0.1 | 0.1 Mg | 2.8 | 460 | | 420 | | 300 | 3 | 6 | 6 |
| 125 | | | | | | | | | | | | 3 | 6 | 10 |
| 126 | | | | | | | | | | | | 3 | 6 | 15 |
| No. Comparative Example | | | | | | | | | | | | | | |
| 1 | 1.8 | 1 | 0.65 | — | — | 2.8 | — | — | 420 | 6 | 300 | — | 6 | 15 |
| 2 | | | | | | | | | | 6 | | | 6 | 10 |
| 3 | | | | | | | | | | 6 | | | 6 | 6 |
| 4 | | | | | | | 460 | 6 | — | 6 | 300 | 3 | — | 15 |
| 5 | | | | | | | | 6 | | 6 | | 3 | | 10 |
| 6 | | | | | | | | 6 | | 6 | | 3 | | 6 |
| 7 | | | | | | | 460 | 6 | — | — | — | 3 | — | — |
| 8 | | | | | | | | 6 | | | | 6 | | |
| 9 | | | | | | | | 6 | | | | 12 | | |
| 10 | | | | | | | — | — | — | — | 300 | — | — | 15 |
| 11 | | | | | | | | | | | | | | 10 |
| 12 | | | | | | | | | | | | | | 6 |
| 13 | 1.8 | 1.0 | 0.65 | — | — | 2.8 | 400 | 6 | 360 | 6 | 330 | 6 | 12 | 0 |
| 14 | | | | | | | | 6 | | 6 | | 6 | 12 | 1 |
| 15 | | | | | | | | 6 | | 6 | | 6 | 12 | 3 |
| 16 | | | | | | | | 6 | | 6 | | 12 | 6 | 0 |
| 17 | | | | | | | | 6 | | 6 | | 12 | 6 | 1 |
| 18 | | | | | | | | 6 | | 6 | | 12 | 6 | 3 |
| 19 | | | | | | | | 6 | | 6 | | 12 | 12 | 0 |
| 20 | | | | | | | | 6 | | 6 | | 12 | 12 | 1 |
| 21 | | | | | | | | 6 | | 6 | | 12 | 12 | 3 |
| 22 | | | | | | | 460 | 6 | 420 | 6 | 270 | 3 | 6 | 0 |
| 23 | | | | | | | | 6 | | 6 | | 3 | 6 | 1 |
| 24 | | | | | | | | 6 | | 6 | | 3 | 6 | 3 |
| 25 | | | | | | | | 6 | | 6 | | 6 | 6 | 0 |
| 26 | | | | | | | | 6 | | 6 | | 6 | 6 | 1 |
| 27 | | | | | | | | 6 | | 6 | | 6 | 6 | 3 |
| 28 | | | | | | | | 6 | | 6 | | 6 | 12 | 0 |
| 29 | | | | | | | | 6 | | 6 | | 6 | 12 | 1 |
| 30 | | | | | | | | 6 | | 6 | | 6 | 12 | 3 |
| 31 | | | | | | | 460 | 6 | 420 | 6 | 300 | 3 | 6 | 0 |
| 32 | | | | | | | | 6 | | 6 | | 3 | 6 | 1 |
| 33 | | | | | | | | 6 | | 6 | | 3 | 6 | 3 |
| 34 | | | | | | | | 6 | | 6 | | 6 | 6 | 0 |
| 35 | | | | | | | | 6 | | 6 | | 6 | 6 | 1 |
| 36 | | | | | | | | 6 | | 6 | | 6 | 6 | 3 |
| 37 | | | | | | | | 6 | | 6 | | 6 | 12 | 0 |
| 38 | | | | | | | | 6 | | 6 | | 6 | 12 | 1 |
| 39 | | | | | | | | 6 | | 6 | | 6 | 12 | 3 |
| 40 | | | | | | | 460 | 6 | 420 | 6 | 330 | 3 | 6 | 0 |
| 41 | | | | | | | | 6 | | 6 | | 3 | 6 | 1 |
| 42 | | | | | | | | 6 | | 6 | | 3 | 6 | 3 |
| 43 | | | | | | | | 6 | | 6 | | 6 | 6 | 0 |
| 44 | | | | | | | | 6 | | 6 | | 6 | 6 | 1 |
| 45 | | | | | | | | 6 | | 6 | | 6 | 6 | 3 |
| 46 | | | | | | | | 6 | | 6 | | 6 | 12 | 0 |
| 47 | | | | | | | | 6 | | 6 | | 6 | 12 | 1 |
| 48 | | | | | | | | 6 | | 6 | | 6 | 12 | 3 |
| 49 | | | | | | | 500 | 6 | 450 | 6 | 270 | 1 | 3 | 0 |
| 50 | | | | | | | | 6 | | 6 | | 1 | 3 | 1 |
| 51 | | | | | | | | 6 | | 6 | | 1 | 3 | 3 |
| 52 | | | | | | | | 6 | | 6 | | 1 | 6 | 0 |
| 53 | | | | | | | | 6 | | 6 | | 1 | 6 | 1 |
| 54 | | | | | | | | 6 | | 6 | | 1 | 6 | 3 |
| 55 | | | | | | | | 6 | | 6 | | 3 | 3 | 0 |
| 56 | | | | | | | | 6 | | 6 | | 3 | 3 | 1 |
| 57 | | | | | | | | 6 | | 6 | | 3 | 3 | 3 |
| 58 | 1.8 | 1 | 0.65 | 0.1 | — | 2.8 | — | — | 420 | 6 | 300 | — | 6 | 15 |
| 59 | | | | | | | | — | | 6 | | — | 6 | 10 |
| 60 | | | | | | | | — | | 6 | | — | 6 | 6 |

TABLE 1-continued

| | | | | | | | | | | | | | | |
|---|---|---|---|---|---|---|---|---|---|---|---|---|---|---|
| 61 | | | | | | | 460 | 6 | — | 6 | 300 | 3 | — | 15 |
| 62 | | | | | | | | 6 | | 6 | | 3 | — | 10 |
| 63 | | | | | | | | 6 | | 6 | | 3 | — | 6 |
| 64 | | | | | | | 460 | 6 | — | — | — | 3 | — | — |
| 65 | | | | | | | | 6 | | — | | 6 | | |
| 66 | | | | | | | | 6 | | — | | 12 | | |
| 67 | | | | | | | — | — | — | — | 300 | — | — | 15 |
| 68 | | | | | | | | 6 | | 6 | | | | 10 |
| 69 | | | | | | | | 6 | | 6 | | | | 6 |
| 70 | 1.8 | 1.0 | 0.65 | 0.1 | — | 2.8 | 400 | 6 | 360 | 6 | 330 | 6 | 12 | 0 |
| 71 | | | | | | | | 6 | | 6 | | 6 | 12 | 1 |
| 72 | | | | | | | | 6 | | 6 | | 6 | 12 | 3 |
| 73 | | | | | | | | 6 | | 6 | | 12 | 6 | 0 |
| 74 | | | | | | | | 6 | | 6 | | 12 | 6 | 1 |
| 75 | | | | | | | | 6 | | 6 | | 12 | 6 | 3 |
| 76 | | | | | | | | 6 | | 6 | | 12 | 12 | 0 |
| 77 | | | | | | | | 6 | | 6 | | 12 | 12 | 1 |
| 78 | | | | | | | | 6 | | 6 | | 12 | 12 | 3 |
| 79 | | | | | | | 460 | 6 | 420 | 6 | 270 | 3 | 6 | 0 |
| 80 | | | | | | | | 6 | | 6 | | 3 | 6 | 1 |
| 81 | | | | | | | | 6 | | 6 | | 3 | 6 | 3 |
| 82 | | | | | | | | 6 | | 6 | | 6 | 6 | 0 |
| 83 | | | | | | | | 6 | | 6 | | 6 | 6 | 1 |
| 84 | | | | | | | | 6 | | 6 | | 6 | 6 | 3 |
| 85 | | | | | | | | 6 | | 6 | | 6 | 12 | 0 |
| 86 | | | | | | | | 6 | | 6 | | 6 | 12 | 1 |
| 87 | | | | | | | | 6 | | 6 | | 6 | 12 | 3 |
| 88 | | | | | | | 460 | 6 | 420 | 6 | 300 | 3 | 6 | 0 |
| 89 | | | | | | | | 6 | | 6 | | 3 | 6 | 1 |
| 90 | | | | | | | | 6 | | 6 | | 3 | 6 | 3 |
| 91 | | | | | | | | 6 | | 6 | | 6 | 6 | 0 |
| 92 | | | | | | | | 6 | | 6 | | 6 | 6 | 1 |
| 93 | | | | | | | | 6 | | 6 | | 6 | 6 | 3 |
| 94 | | | | | | | | 6 | | 6 | | 6 | 12 | 0 |
| 95 | | | | | | | | 6 | | 6 | | 6 | 12 | 1 |
| 96 | | | | | | | | 6 | | 6 | | 6 | 12 | 3 |
| 97 | | | | | | | 460 | 6 | 420 | 6 | 330 | 3 | 6 | 0 |
| 98 | | | | | | | | 6 | | 6 | | 3 | 6 | 1 |
| 99 | | | | | | | | 6 | | 6 | | 3 | 6 | 3 |
| 100 | | | | | | | | 6 | | 6 | | 6 | 6 | 0 |
| 101 | | | | | | | | 6 | | 6 | | 6 | 6 | 1 |
| 102 | | | | | | | | 6 | | 6 | | 6 | 6 | 3 |
| 103 | | | | | | | | 6 | | 6 | | 6 | 12 | 0 |
| 104 | | | | | | | | 6 | | 6 | | 6 | 12 | 1 |
| 105 | | | | | | | | 6 | | 6 | | 6 | 12 | 3 |
| 106 | | | | | | | 500 | 6 | 450 | 6 | 270 | 1 | 3 | 0 |
| 107 | | | | | | | | 6 | | 6 | | 1 | 3 | 1 |
| 108 | | | | | | | | 6 | | 6 | | 1 | 3 | 3 |
| 109 | | | | | | | | 6 | | 6 | | 1 | 6 | 0 |
| 110 | | | | | | | | 6 | | 6 | | 1 | 6 | 1 |
| 111 | | | | | | | | 6 | | 6 | | 1 | 6 | 3 |
| 112 | | | | | | | | 6 | | 6 | | 3 | 3 | 0 |
| 113 | | | | | | | | 6 | | 6 | | 3 | 3 | 1 |
| 114 | | | | | | | | 6 | | 6 | | 3 | 3 | 3 |
| 115 | | | | | | | 460 | 6 | 420 | 6 | 200 | 3 | 6 | 6 |
| 116 | | | | | | | | 6 | | 6 | | | | 10 |
| 117 | | | | | | | | 6 | | 6 | | | | 15 |
| 118 | | | | | | | 460 | 6 | 420 | 6 | 400 | 3 | 6 | 6 |
| 119 | | | | | | | | 6 | | 6 | | | | 10 |
| 120 | | | | | | | | 6 | | 6 | | | | 15 |
| 121 | | | | | | | 460 | 6 | 420 | 6 | 300 | 3 | 6 | 40 |
| 122 | | | | | | | | 6 | | 6 | | | | 60 |
| 123 | | | | | | | | 6 | | 6 | | | | 80 |
| 124 | 1 | 0.5 | 0.34 | — | — | 1.5 | 460 | 6 | 420 | 6 | 300 | 3 | 6 | 0 |
| 125 | | | | | | | | 6 | | 6 | | 3 | 6 | 1 |
| 126 | | | | | | | | 6 | | 6 | | 3 | 6 | 3 |
| 127 | 2.5 | 1.5 | 0.91 | — | — | 4 | 460 | 6 | 420 | 6 | 300 | 3 | 6 | 0 |
| 128 | | | | | | | | 6 | | 6 | | 3 | 6 | 1 |
| 129 | | | | | | | | 6 | | 6 | | 3 | 6 | 3 |
| 130 | 1 | 0.5 | 0.34 | 0.1 | — | 1.5 | 460 | 6 | 420 | 6 | 300 | 3 | 6 | 0 |
| 131 | | | | | | | | 6 | | 6 | | 3 | 6 | 1 |
| 132 | | | | | | | | 6 | | 6 | | 3 | 6 | 3 |
| 133 | 2.5 | 1.5 | 0.91 | 0.1 | — | 4 | 460 | 6 | 420 | 6 | 300 | 3 | 6 | 0 |
| 134 | | | | | | | | 6 | | 6 | | 3 | 6 | 1 |
| 135 | | | | | | | | 6 | | 6 | | 3 | 6 | 3 |
| 136 | 1.8 | 1.0 | 0.65 | — | 0.5 Sn | 2.8 | 460 | 6 | 420 | 6 | 300 | 3 | 6 | 0 |
| 137 | | | | | | | | 6 | | 6 | | 3 | 6 | 1 |
| 138 | | | | | | | | 6 | | 6 | | 3 | 6 | 3 |
| 139 | 1.8 | 1.0 | 0.65 | — | 0.5 Zn | 2.8 | 460 | 6 | 420 | 6 | 300 | 3 | 6 | 0 |
| 140 | | | | | | | | 6 | | 6 | | 3 | 6 | 1 |

TABLE 1-continued

| | | | | | | | | | | | | | | |
|---|---|---|---|---|---|---|---|---|---|---|---|---|---|---|
| 141 | | | | | | | | 6 | | 6 | | 3 | 6 | 3 |
| 142 | 1.8 | 1.0 | 0.65 | — | 0.1 Ag | 2.8 | 460 | 6 | 420 | 6 | 300 | 3 | 6 | 0 |
| 143 | | | | | | | | 6 | | 6 | | 3 | 6 | 1 |
| 144 | | | | | | | | 6 | | 6 | | 3 | 6 | 3 |
| 145 | 1.8 | 1.0 | 0.65 | — | 0.1 Mg | 2.8 | 460 | 6 | 420 | 6 | 300 | 3 | 6 | 0 |
| 146 | | | | | | | | 6 | | 6 | | 3 | 6 | 1 |
| 147 | | | | | | | | 6 | | 6 | | 3 | 6 | 3 |
| 148 | 1.8 | 1.0 | 0.65 | 0.1 | 0.5 Sn | 2.8 | 460 | 6 | 420 | 6 | 300 | 3 | 6 | 0 |
| 149 | | | | | | | | 6 | | 6 | | 3 | 6 | 1 |
| 150 | | | | | | | | 6 | | 6 | | 3 | 6 | 3 |
| 151 | 1.8 | 1.0 | 0.65 | 0.1 | 0.5 Zn | 2.8 | 460 | 6 | 420 | 6 | 300 | 3 | 6 | 0 |
| 152 | | | | | | | | 6 | | 6 | | 3 | 6 | 1 |
| 153 | | | | | | | | 6 | | 6 | | 3 | 6 | 3 |
| 154 | 1.8 | 1.0 | 0.65 | 0.1 | 0.1 Ag | 2.8 | 460 | 6 | 420 | 6 | 300 | 3 | 6 | 0 |
| 155 | | | | | | | | 6 | | 6 | | 3 | 6 | 1 |
| 156 | | | | | | | | 6 | | 6 | | 3 | 6 | 3 |
| 157 | 1.8 | 1.0 | 0.65 | 0.1 | 0.1 Mg | 2.8 | 460 | 6 | 420 | 6 | 300 | 3 | 6 | 0 |
| 158 | | | | | | | | 6 | | 6 | | 3 | 6 | 1 |
| 159 | | | | | | | | 6 | | 6 | | 3 | 6 | 3 |

| | | Composition (mass %) | | | | | | First aging treatment | | | | | | | |
|---|---|---|---|---|---|---|---|---|---|---|---|---|---|---|---|
| | No. | Ni | Co | Si | Cr | Others | Ni + Co | First stage temperature (° C.) | First stage → second stage cooling rate (° C./min) | Second stage temperature (° C.) | Second stage → third stage cooling rate (° C./min) | Third stage temperature (° C.) | First stage time (hr) | Second stage time (hr) | Third stage time (hr) |
| Example | 127 | 1.8 | 1.0 | 0.65 | — | — | 2.8 | 460 | 6 | 420 | 6 | 300 | 3 | 6 | 6 |
| Example | 128 | 1.8 | 1.0 | 0.65 | — | — | 2.8 | 460 | 6 | 420 | 6 | 300 | 3 | 6 | 10 |
| Example | 129 | 1.8 | 1.0 | 0.65 | — | — | 2.8 | 460 | 6 | 420 | 6 | 300 | 3 | 6 | 15 |
| Example | 130 | 1.0 | 0.5 | 0.34 | — | — | 1.5 | 460 | 6 | 420 | 6 | 300 | 3 | 6 | 6 |
| Example | 131 | 1.0 | 0.5 | 0.34 | — | — | 1.5 | 460 | 6 | 420 | 6 | 300 | 3 | 6 | 10 |
| Example | 132 | 1.0 | 0.5 | 0.34 | — | — | 1.5 | 460 | 6 | 420 | 6 | 300 | 3 | 6 | 15 |
| Example | 133 | 2.5 | 1.5 | 0.91 | — | — | 4.0 | 460 | 6 | 420 | 6 | 300 | 3 | 6 | 6 |
| Example | 134 | 2.5 | 1.5 | 0.91 | — | — | 4.0 | 460 | 6 | 420 | 6 | 300 | 3 | 6 | 10 |
| Example | 135 | 2.5 | 1.5 | 0.91 | — | — | 4.0 | 460 | 6 | 420 | 6 | 300 | 3 | 6 | 15 |
| Example | 136 | 1.8 | 1.0 | 0.65 | 0.1 | — | 2.8 | 460 | 6 | 420 | 6 | 300 | 3 | 6 | 6 |
| Example | 137 | 1.8 | 1.0 | 0.65 | 0.1 | — | 2.8 | 460 | 6 | 420 | 6 | 300 | 3 | 6 | 10 |
| Example | 138 | 1.8 | 1.0 | 0.65 | 0.1 | — | 2.8 | 460 | 6 | 420 | 6 | 300 | 3 | 6 | 15 |
| Example | 139 | 1.0 | 0.5 | 0.34 | 0.1 | — | 1.5 | 460 | 6 | 420 | 6 | 300 | 3 | 6 | 6 |
| Example | 140 | 1.0 | 0.5 | 0.34 | 0.1 | — | 1.5 | 460 | 6 | 420 | 6 | 300 | 3 | 6 | 10 |
| Example | 141 | 1.0 | 0.5 | 0.34 | 0.1 | — | 1.5 | 460 | 6 | 420 | 6 | 300 | 3 | 6 | 15 |
| Example | 142 | 2.5 | 1.5 | 0.91 | 0.1 | — | 4.0 | 460 | 6 | 420 | 6 | 300 | 3 | 6 | 6 |
| Example | 143 | 2.5 | 1.5 | 0.91 | 0.1 | — | 4.0 | 460 | 6 | 420 | 6 | 300 | 3 | 6 | 10 |
| Example | 144 | 2.5 | 1.5 | 0.91 | 0.1 | — | 4.0 | 460 | 6 | 420 | 6 | 300 | 3 | 6 | 15 |
| Comparative Example | 160 | 1.8 | 1.0 | 0.65 | — | — | 2.8 | 460 | — | — | — | — | 3 | — | — |
| Comparative Example | 161 | 1.0 | 0.5 | 0.34 | — | — | 1.5 | 460 | — | — | — | — | 3 | — | — |
| Comparative Example | 162 | 2.5 | 1.5 | 0.91 | — | — | 4.0 | 460 | — | — | — | — | 3 | — | — |
| Comparative Example | 163 | 1.8 | 1.0 | 0.65 | 0.1 | — | 2.8 | 460 | — | — | — | — | 3 | — | — |
| Comparative Example | 164 | 1.0 | 0.5 | 0.34 | 0.1 | — | 1.5 | 460 | — | — | — | — | 3 | — | — |
| Comparative Example | 165 | 2.5 | 1.5 | 0.91 | 0.1 | — | 4.0 | 460 | — | — | — | — | 3 | — | — |

For the various specimens obtained as such, the number density of the second phase particles and the alloy characteristics were measured in the following manner.

When second phase particles having a particle size of from 0.1 μm to 1 μm were observed, first, a material surface (rolled surface) was electrolytically polished to dissolve the matrix of Cu, and the second phase particles were left behind to be exposed. The electrolytic polishing liquid used was a mixture of phosphoric acid, sulfuric acid and pure water at an appropriate ratio. Second phase particles having a particle size of 0.1 μm to 1 μm that are dispersed in any arbitrary 10 sites were all observed and analyzed by using an FE-EPMA (field emission type EPMA: JXA-8500F manufactured by JEOL, Ltd.) and using an accelerating voltage of 5 kV to 10 kV, a sample current of $2\times10^{-8}$ A to $10^{-10}$ A, and analyzing crystals of LDE, TAP, PET and LIF, at a magnification ratio of 3000 times (observation field of vision: 30 μm×30 μm). The numbers of precipitates were counted, and the numbers per square millimeter ($mm^2$) was calculated.

With regard to strength, a tensile test in the direction parallel to rolling was carried out according to JIS Z2241, and 0.2% yield strength (YS: MPa) was measured.

Electrical conductivity (EC; % IACS) was determined by measuring the volume resistivity by a double bridge method.

With regard to spring bending elastic limit, a repetitive bending test was carried out according to JIS H3130, and the maximum surface stress was measured from the bending moment with residual permanent strain. Spring bending elastic limit was measured even before acid pickling and polishing.

The peak height ratio at a β angle of 90° was determined by the measurement method described above, by using an X-ray diffraction apparatus of Model RINT-2500V manufactured by Rigaku Corp.

With regard to solder wettability, the time (t2) taken from the initiation of immersion to the time point where the wetting force passes zero (0), was determined by a meniscograph method, and solder wettability was evaluated based on the following criteria.

○: t2 is 2 seconds or less.

x: t2 is greater than 2 seconds.

The test results for various specimens are presented in Table 2.

TABLE 2

| No. Example | Kb before acid pickling/polishing (MPa) | Kb after acid pickling/polishing (MPa) | Peak height ratio at β angle of 90° | Second phase particles having particle size of from 0.1 μm to 1 μm (×10^5) | YS (MPa) | EC (% IACS) | Solder wettability t2 (s) |
|---|---|---|---|---|---|---|---|
| 1 | 495 | 425 | 2.8 | 0.5 | 825 | 42 | ○ |
| 2 | 500 | 433 | 2.9 | 0.5 | 829 | 43 | ○ |
| 3 | 505 | 436 | 2.9 | 0.4 | 834 | 43 | ○ |
| 4 | 502 | 430 | 2.9 | 0.6 | 827 | 42 | ○ |
| 5 | 508 | 434 | 2.9 | 0.7 | 835 | 43 | ○ |
| 6 | 511 | 435 | 2.9 | 0.8 | 839 | 43 | ○ |
| 7 | 508 | 435 | 2.9 | 0.7 | 835 | 43 | ○ |
| 8 | 511 | 438 | 2.9 | 0.8 | 840 | 44 | ○ |
| 9 | 513 | 440 | 3.0 | 0.8 | 845 | 44 | ○ |
| 10 | 510 | 440 | 3.0 | 0.5 | 850 | 44 | ○ |
| 11 | 518 | 446 | 3.0 | 0.5 | 855 | 44 | ○ |
| 12 | 520 | 448 | 3.0 | 0.5 | 860 | 45 | ○ |
| 13 | 514 | 440 | 3.0 | 0.6 | 835 | 46 | ○ |
| 14 | 520 | 445 | 3.0 | 0.7 | 840 | 46 | ○ |
| 15 | 522 | 447 | 3.0 | 0.7 | 845 | 47 | ○ |
| 16 | 511 | 435 | 2.9 | 0.7 | 825 | 46 | ○ |
| 17 | 516 | 441 | 3.0 | 0.8 | 830 | 47 | ○ |
| 18 | 518 | 443 | 3.0 | 0.8 | 835 | 48 | ○ |
| 19 | 524 | 450 | 3.1 | 0.5 | 860 | 45 | ○ |
| 20 | 521 | 446 | 3.0 | 0.5 | 855 | 45 | ○ |
| 21 | 516 | 440 | 3.0 | 0.4 | 850 | 44 | ○ |
| 22 | 511 | 437 | 3.0 | 0.7 | 830 | 45 | ○ |
| 23 | 515 | 440 | 3.0 | 0.8 | 835 | 45 | ○ |
| 24 | 516 | 440 | 3.0 | 0.8 | 840 | 46 | ○ |
| 25 | 504 | 430 | 2.9 | 0.7 | 825 | 45 | ○ |
| 26 | 515 | 440 | 3.0 | 0.8 | 830 | 45 | ○ |
| 27 | 516 | 441 | 3.0 | 0.8 | 835 | 46 | ○ |
| 28 | 515 | 441 | 3.0 | 0.6 | 855 | 45 | ○ |
| 29 | 506 | 432 | 2.9 | 0.5 | 845 | 46 | ○ |
| 30 | 501 | 425 | 2.9 | 0.5 | 840 | 46 | ○ |
| 31 | 507 | 432 | 2.9 | 0.7 | 845 | 45 | ○ |
| 32 | 498 | 423 | 2.8 | 0.8 | 835 | 46 | ○ |
| 33 | 491 | 415 | 2.8 | 0.8 | 830 | 46 | ○ |
| 34 | 505 | 430 | 2.9 | 0.7 | 835 | 46 | ○ |
| 35 | 501 | 425 | 2.9 | 0.8 | 830 | 47 | ○ |
| 36 | 491 | 416 | 2.8 | 0.9 | 825 | 47 | ○ |
| 37 | 515 | 440 | 3.0 | 0.5 | 830 | 43 | ○ |
| 38 | 522 | 448 | 3.0 | 0.5 | 840 | 44 | ○ |
| 39 | 525 | 450 | 3.1 | 0.4 | 845 | 44 | ○ |
| 40 | 509 | 433 | 2.9 | 0.7 | 825 | 45 | ○ |
| 41 | 515 | 440 | 3.0 | 0.8 | 830 | 46 | ○ |
| 42 | 519 | 443 | 3.0 | 0.8 | 835 | 46 | ○ |
| 43 | 510 | 435 | 2.9 | 0.7 | 825 | 45 | ○ |
| 44 | 516 | 440 | 3.0 | 0.8 | 830 | 46 | ○ |
| 45 | 517 | 442 | 3.0 | 0.8 | 835 | 46 | ○ |
| 46 | 499 | 425 | 2.8 | 0.5 | 840 | 43 | ○ |
| 47 | 503 | 428 | 2.9 | 0.5 | 843 | 44 | ○ |
| 48 | 504 | 430 | 2.9 | 0.4 | 848 | 44 | ○ |
| 49 | 505 | 430 | 2.9 | 0.7 | 840 | 43 | ○ |
| 50 | 510 | 436 | 2.9 | 0.8 | 850 | 44 | ○ |
| 51 | 512 | 437 | 2.9 | 0.8 | 854 | 44 | ○ |
| 52 | 511 | 435 | 2.9 | 0.7 | 850 | 44 | ○ |
| 53 | 518 | 443 | 3.0 | 0.8 | 855 | 45 | ○ |
| 54 | 520 | 444 | 3.0 | 0.8 | 860 | 45 | ○ |
| 55 | 515 | 440 | 3.0 | 0.5 | 860 | 45 | ○ |
| 56 | 519 | 445 | 3.0 | 0.5 | 865 | 45 | ○ |
| 57 | 523 | 448 | 3.0 | 0.4 | 870 | 46 | ○ |
| 58 | 515 | 440 | 3.0 | 0.7 | 845 | 47 | ○ |
| 59 | 521 | 445 | 3.0 | 0.8 | 850 | 47 | ○ |

TABLE 2-continued

| | | | | | | | |
|---|---|---|---|---|---|---|---|
| 60 | 521 | 446 | 3.0 | 0.8 | 855 | 48 | ○ |
| 61 | 511 | 435 | 2.9 | 0.7 | 840 | 47 | ○ |
| 62 | 515 | 440 | 3.0 | 0.8 | 845 | 48 | ○ |
| 63 | 518 | 442 | 3.0 | 0.8 | 855 | 49 | ○ |
| 64 | 525 | 450 | 3.1 | 0.5 | 870 | 46 | ○ |
| 65 | 523 | 447 | 3.0 | 0.5 | 865 | 46 | ○ |
| 66 | 510 | 435 | 2.9 | 0.5 | 860 | 45 | ○ |
| 67 | 503 | 427 | 2.8 | 0.7 | 850 | 46 | ○ |
| 68 | 509 | 434 | 2.9 | 0.8 | 855 | 46 | ○ |
| 69 | 511 | 435 | 2.9 | 0.8 | 860 | 47 | ○ |
| 70 | 505 | 430 | 2.8 | 0.7 | 840 | 46 | ○ |
| 71 | 513 | 436 | 2.9 | 0.8 | 845 | 46 | ○ |
| 72 | 513 | 438 | 3.0 | 0.8 | 850 | 47 | ○ |
| 73 | 516 | 441 | 3.0 | 0.6 | 870 | 46 | ○ |
| 74 | 512 | 438 | 3.0 | 0.5 | 860 | 47 | ○ |
| 75 | 508 | 433 | 2.9 | 0.5 | 855 | 47 | ○ |
| 76 | 503 | 428 | 2.8 | 0.7 | 860 | 46 | ○ |
| 77 | 499 | 425 | 2.8 | 0.8 | 855 | 47 | ○ |
| 78 | 491 | 416 | 2.7 | 0.8 | 850 | 47 | ○ |
| 79 | 501 | 426 | 2.8 | 0.7 | 850 | 47 | ○ |
| 80 | 495 | 421 | 2.8 | 0.8 | 843 | 48 | ○ |
| 81 | 491 | 416 | 2.7 | 0.9 | 840 | 48 | ○ |
| 82 | 511 | 436 | 3.0 | 0.5 | 845 | 44 | ○ |
| 83 | 520 | 445 | 3.1 | 0.5 | 855 | 45 | ○ |
| 84 | 523 | 448 | 3.1 | 0.4 | 860 | 45 | ○ |
| 85 | 506 | 433 | 2.9 | 0.7 | 840 | 46 | ○ |
| 86 | 515 | 440 | 3.0 | 0.8 | 843 | 47 | ○ |
| 87 | 517 | 443 | 3.0 | 0.8 | 848 | 47 | ○ |
| 88 | 510 | 435 | 2.9 | 0.7 | 840 | 46 | ○ |
| 89 | 512 | 439 | 3.0 | 0.8 | 843 | 47 | ○ |
| 90 | 517 | 442 | 3.0 | 0.8 | 850 | 47 | ○ |
| 91 | 483 | 408 | 2.8 | 0.1 | 717 | 51 | ○ |
| 92 | 495 | 420 | 2.9 | 0.1 | 722 | 52 | ○ |
| 93 | 498 | 424 | 2.8 | 0.2 | 730 | 52 | ○ |
| 94 | 537 | 462 | 3.2 | 1.8 | 929 | 39 | ○ |
| 95 | 549 | 472 | 3.2 | 1.9 | 935 | 40 | ○ |
| 96 | 550 | 475 | 3.2 | 1.9 | 940 | 40 | ○ |
| 97 | 486 | 410 | 2.7 | 0.2 | 727 | 52 | ○ |
| 98 | 497 | 422 | 2.8 | 0.2 | 732 | 53 | ○ |
| 99 | 502 | 426 | 2.8 | 0.2 | 740 | 53 | ○ |
| 100 | 540 | 465 | 3.1 | 1.9 | 939 | 39 | ○ |
| 101 | 551 | 475 | 3.1 | 2.0 | 945 | 40 | ○ |
| 102 | 553 | 478 | 3.1 | 2.0 | 950 | 40 | ○ |
| 103 | 510 | 435 | 2.9 | 0.5 | 860 | 41 | ○ |
| 104 | 521 | 445 | 3.0 | 0.5 | 865 | 42 | ○ |
| 105 | 525 | 450 | 3.0 | 0.5 | 870 | 43 | ○ |
| 106 | 503 | 430 | 2.9 | 0.5 | 860 | 41 | ○ |
| 107 | 517 | 442 | 2.9 | 0.5 | 865 | 42 | ○ |
| 108 | 526 | 450 | 3.0 | 0.6 | 870 | 42 | ○ |
| 109 | 508 | 433 | 2.9 | 0.5 | 845 | 43 | ○ |
| 110 | 512 | 440 | 3.0 | 0.5 | 850 | 43 | ○ |
| 111 | 520 | 445 | 3.0 | 0.5 | 860 | 44 | ○ |
| 112 | 524 | 450 | 3.0 | 0.5 | 875 | 42 | ○ |
| 113 | 535 | 460 | 3.1 | 0.5 | 880 | 42 | ○ |
| 114 | 539 | 465 | 3.1 | 0.6 | 885 | 43 | ○ |
| 115 | 518 | 443 | 2.9 | 0.5 | 865 | 44 | ○ |
| 116 | 524 | 450 | 3.0 | 0.5 | 870 | 44 | ○ |
| 117 | 530 | 455 | 3.1 | 0.6 | 880 | 45 | ○ |
| 118 | 518 | 444 | 3.0 | 0.5 | 855 | 42 | ○ |
| 119 | 525 | 450 | 3.1 | 0.5 | 860 | 43 | ○ |
| 120 | 529 | 455 | 3.1 | 0.6 | 870 | 44 | ○ |
| 121 | 517 | 442 | 3.0 | 0.5 | 860 | 44 | ○ |
| 122 | 521 | 448 | 3.1 | 0.6 | 865 | 44 | ○ |
| 123 | 525 | 450 | 3.1 | 0.6 | 870 | 45 | ○ |
| 124 | 532 | 458 | 3.1 | 0.5 | 885 | 43 | ○ |
| 125 | 540 | 465 | 3.1 | 0.6 | 890 | 43 | ○ |
| 126 | 543 | 470 | 3.2 | 0.6 | 895 | 44 | ○ |
| No. Comparative Example | | | | | | | |
| 1 | 459 | 385 | 1.8 | 0.4 | 785 | 40 | ○ |
| 2 | 457 | 382 | 1.8 | 0.4 | 780 | 40 | ○ |
| 3 | 449 | 374 | 1.7 | 0.4 | 775 | 39 | ○ |
| 4 | 451 | 388 | 1.8 | 0.9 | 790 | 41 | ○ |
| 5 | 460 | 385 | 1.7 | 0.8 | 785 | 41 | ○ |
| 6 | 450 | 376 | 1.6 | 0.8 | 780 | 40 | ○ |
| 7 | 459 | 384 | 1.7 | 0.7 | 785 | 40 | ○ |
| 8 | 454 | 381 | 1.7 | 0.7 | 780 | 41 | ○ |
| 9 | 449 | 374 | 1.6 | 0.8 | 770 | 42 | ○ |

TABLE 2-continued

| | | | | | | | |
|---|---|---|---|---|---|---|---|
| 10 | 429 | 350 | 1.6 | 0.2 | 500 | 24 | ○ |
| 11 | 420 | 345 | 1.6 | 0.2 | 490 | 23 | ○ |
| 12 | 407 | 332 | 1.5 | 0.1 | 485 | 22 | ○ |
| 13 | 459 | 385 | 1.8 | 0.5 | 790 | 41 | ○ |
| 14 | 470 | 395 | 1.9 | 0.6 | 795 | 42 | ○ |
| 15 | 474 | 398 | 2.0 | 0.4 | 800 | 42 | ○ |
| 16 | 465 | 390 | 1.9 | 0.7 | 795 | 41 | ○ |
| 17 | 473 | 398 | 1.9 | 0.8 | 800 | 42 | ○ |
| 18 | 476 | 400 | 2.0 | 0.8 | 805 | 42 | ○ |
| 19 | 469 | 393 | 1.9 | 0.7 | 800 | 42 | ○ |
| 20 | 475 | 400 | 2.0 | 0.8 | 805 | 43 | ○ |
| 21 | 478 | 403 | 2.0 | 0.8 | 810 | 43 | ○ |
| 22 | 470 | 395 | 1.9 | 0.5 | 805 | 43 | ○ |
| 23 | 478 | 403 | 2.0 | 0.5 | 810 | 43 | ○ |
| 24 | 480 | 405 | 2.1 | 0.5 | 814 | 44 | ○ |
| 25 | 461 | 388 | 1.8 | 0.7 | 795 | 45 | ○ |
| 26 | 470 | 395 | 1.8 | 0.7 | 800 | 45 | ○ |
| 27 | 475 | 398 | 1.9 | 0.7 | 805 | 46 | ○ |
| 28 | 460 | 385 | 1.8 | 0.7 | 790 | 45 | ○ |
| 29 | 468 | 395 | 1.9 | 0.8 | 797 | 46 | ○ |
| 30 | 472 | 397 | 1.9 | 0.8 | 800 | 47 | ○ |
| 31 | 468 | 395 | 1.9 | 0.5 | 805 | 44 | ○ |
| 32 | 478 | 403 | 2.0 | 0.5 | 810 | 44 | ○ |
| 33 | 479 | 404 | 2.1 | 0.7 | 814 | 43 | ○ |
| 34 | 461 | 388 | 1.8 | 0.7 | 795 | 44 | ○ |
| 35 | 472 | 397 | 1.9 | 0.7 | 805 | 44 | ○ |
| 36 | 475 | 400 | 2.0 | 0.8 | 810 | 45 | ○ |
| 37 | 459 | 385 | 1.7 | 0.7 | 790 | 44 | ○ |
| 38 | 467 | 392 | 1.8 | 0.8 | 800 | 44 | ○ |
| 39 | 460 | 395 | 1.8 | 0.8 | 805 | 45 | ○ |
| 40 | 470 | 395 | 1.8 | 0.5 | 805 | 44 | ○ |
| 41 | 476 | 402 | 2.1 | 0.5 | 810 | 45 | ○ |
| 42 | 480 | 405 | 2.2 | 0.7 | 813 | 45 | ○ |
| 43 | 463 | 388 | 1.8 | 0.7 | 795 | 44 | ○ |
| 44 | 471 | 395 | 1.9 | 0.7 | 800 | 45 | ○ |
| 45 | 475 | 400 | 2.0 | 0.8 | 805 | 45 | ○ |
| 46 | 462 | 387 | 2.0 | 0.7 | 790 | 45 | ○ |
| 47 | 468 | 394 | 1.9 | 0.8 | 800 | 46 | ○ |
| 48 | 472 | 397 | 1.9 | 0.8 | 805 | 46 | ○ |
| 49 | 461 | 387 | 1.9 | 0.6 | 785 | 42 | ○ |
| 50 | 470 | 395 | 1.9 | 0.7 | 790 | 43 | ○ |
| 51 | 472 | 398 | 1.9 | 0.7 | 800 | 43 | ○ |
| 52 | 458 | 383 | 1.8 | 0.8 | 780 | 44 | ○ |
| 53 | 464 | 390 | 1.9 | 0.9 | 785 | 45 | ○ |
| 54 | 470 | 395 | 1.9 | 0.9 | 790 | 45 | ○ |
| 55 | 459 | 385 | 1.8 | 1.0 | 780 | 44 | ○ |
| 56 | 465 | 390 | 1.9 | 1.0 | 785 | 45 | ○ |
| 57 | 469 | 393 | 1.8 | 1.1 | 795 | 45 | ○ |
| 58 | 460 | 385 | 1.8 | 0.5 | 795 | 41 | ○ |
| 59 | 455 | 382 | 1.8 | 0.4 | 790 | 41 | ○ |
| 60 | 449 | 374 | 1.7 | 0.4 | 785 | 40 | ○ |
| 61 | 465 | 388 | 1.8 | 0.8 | 800 | 42 | ○ |
| 62 | 459 | 384 | 1.8 | 0.9 | 795 | 42 | ○ |
| 63 | 451 | 377 | 1.7 | 0.8 | 790 | 41 | ○ |
| 64 | 459 | 384 | 1.8 | 0.7 | 795 | 41 | ○ |
| 65 | 455 | 381 | 1.8 | 0.8 | 790 | 40 | ○ |
| 66 | 449 | 374 | 1.7 | 0.8 | 780 | 42 | ○ |
| 67 | 424 | 350 | 1.7 | 0.2 | 510 | 25 | ○ |
| 68 | 420 | 345 | 1.6 | 0.2 | 500 | 24 | ○ |
| 69 | 408 | 332 | 1.5 | 0.2 | 495 | 23 | ○ |
| 70 | 460 | 385 | 1.6 | 0.6 | 800 | 42 | ○ |
| 71 | 466 | 392 | 1.7 | 0.6 | 805 | 43 | ○ |
| 72 | 469 | 394 | 1.7 | 0.5 | 810 | 43 | ○ |
| 73 | 465 | 390 | 1.6 | 0.7 | 805 | 42 | ○ |
| 74 | 474 | 398 | 1.7 | 0.8 | 810 | 43 | ○ |
| 75 | 477 | 402 | 1.7 | 0.9 | 815 | 43 | ○ |
| 76 | 470 | 395 | 1.6 | 0.7 | 810 | 43 | ○ |
| 77 | 476 | 400 | 1.7 | 0.8 | 815 | 44 | ○ |
| 78 | 478 | 403 | 1.8 | 0.9 | 820 | 44 | ○ |
| 79 | 471 | 395 | 1.7 | 0.6 | 815 | 44 | ○ |
| 80 | 476 | 401 | 1.8 | 0.6 | 817 | 44 | ○ |
| 81 | 479 | 405 | 1.8 | 0.5 | 822 | 45 | ○ |
| 82 | 463 | 388 | 1.8 | 0.7 | 805 | 46 | ○ |
| 83 | 471 | 395 | 1.9 | 0.8 | 812 | 46 | ○ |
| 84 | 473 | 398 | 1.9 | 0.7 | 817 | 47 | ○ |
| 85 | 461 | 387 | 1.6 | 0.7 | 800 | 46 | ○ |
| 86 | 470 | 395 | 1.6 | 0.8 | 807 | 47 | ○ |
| 87 | 474 | 400 | 1.7 | 0.9 | 814 | 48 | ○ |
| 88 | 473 | 398 | 1.7 | 0.6 | 815 | 45 | ○ |
| 89 | 480 | 405 | 1.8 | 0.6 | 820 | 45 | ○ |

TABLE 2-continued

| | | | | | | | |
|---|---|---|---|---|---|---|---|
| 90 | 481 | 407 | 1.8 | 0.8 | 824 | 46 | ○ |
| 91 | 463 | 388 | 1.7 | 0.7 | 805 | 45 | ○ |
| 92 | 471 | 397 | 1.7 | 0.8 | 815 | 45 | ○ |
| 93 | 475 | 400 | 1.8 | 0.8 | 820 | 46 | ○ |
| 94 | 460 | 385 | 1.6 | 0.7 | 800 | 45 | ○ |
| 95 | 468 | 394 | 1.6 | 0.8 | 810 | 45 | ○ |
| 96 | 470 | 395 | 1.7 | 0.8 | 815 | 46 | ○ |
| 97 | 473 | 398 | 1.7 | 0.6 | 815 | 45 | ○ |
| 98 | 478 | 402 | 1.8 | 0.6 | 820 | 46 | ○ |
| 99 | 480 | 405 | 1.9 | 0.8 | 824 | 46 | ○ |
| 100 | 462 | 388 | 1.7 | 0.7 | 805 | 45 | ○ |
| 101 | 470 | 395 | 1.7 | 0.8 | 810 | 46 | ○ |
| 102 | 475 | 399 | 1.8 | 0.8 | 815 | 46 | ○ |
| 103 | 460 | 385 | 1.6 | 0.7 | 800 | 46 | ○ |
| 104 | 469 | 394 | 1.6 | 0.8 | 810 | 47 | ○ |
| 105 | 470 | 395 | 1.7 | 0.9 | 815 | 47 | ○ |
| 106 | 461 | 385 | 1.5 | 0.7 | 795 | 43 | ○ |
| 107 | 465 | 390 | 1.5 | 0.7 | 800 | 44 | ○ |
| 108 | 469 | 393 | 1.5 | 0.8 | 810 | 44 | ○ |
| 109 | 458 | 383 | 1.5 | 0.9 | 790 | 45 | ○ |
| 110 | 465 | 390 | 1.6 | 1.0 | 795 | 46 | ○ |
| 111 | 469 | 393 | 1.6 | 1.0 | 800 | 46 | ○ |
| 112 | 460 | 385 | 1.5 | 1.0 | 790 | 45 | ○ |
| 113 | 462 | 390 | 1.6 | 1.1 | 795 | 46 | ○ |
| 114 | 468 | 393 | 1.6 | 1.2 | 805 | 46 | ○ |
| 115 | 475 | 398 | 1.5 | 0.6 | 815 | 45 | ○ |
| 116 | 479 | 404 | 1.5 | 0.6 | 820 | 45 | ○ |
| 117 | 482 | 406 | 1.5 | 0.8 | 824 | 46 | ○ |
| 118 | 479 | 404 | 1.5 | 0.7 | 822 | 47 | ○ |
| 119 | 474 | 402 | 1.6 | 0.8 | 817 | 48 | ○ |
| 120 | 471 | 396 | 1.5 | 0.9 | 815 | 48 | ○ |
| 121 | 479 | 405 | 1.9 | 0.6 | 820 | 47 | ○ |
| 122 | 478 | 403 | 1.8 | 0.6 | 815 | 48 | ○ |
| 123 | 471 | 397 | 1.8 | 0.7 | 810 | 49 | ○ |
| 124 | 443 | 368 | 1.6 | 0.1 | 670 | 51 | ○ |
| 125 | 451 | 375 | 1.6 | 0.1 | 675 | 51 | ○ |
| 126 | 452 | 377 | 1.7 | 0.2 | 680 | 52 | ○ |
| 127 | 485 | 412 | 2.0 | 1.9 | 880 | 39 | ○ |
| 128 | 491 | 416 | 2.1 | 2.0 | 885 | 39 | ○ |
| 129 | 491 | 418 | 2.2 | 2.0 | 895 | 40 | ○ |
| 130 | 435 | 360 | 1.6 | 0.1 | 680 | 52 | ○ |
| 131 | 441 | 367 | 1.6 | 0.2 | 685 | 53 | ○ |
| 132 | 446 | 371 | 1.7 | 0.2 | 690 | 53 | ○ |
| 133 | 486 | 413 | 2.0 | 2.0 | 890 | 39 | ○ |
| 134 | 492 | 417 | 2.1 | 2.1 | 895 | 39 | ○ |
| 135 | 492 | 419 | 2.2 | 2.1 | 900 | 40 | ○ |
| 136 | 473 | 398 | 1.9 | 0.5 | 820 | 42 | ○ |
| 137 | 478 | 405 | 2.0 | 0.5 | 825 | 42 | ○ |
| 138 | 482 | 407 | 2.0 | 0.6 | 829 | 43 | ○ |
| 139 | 471 | 398 | 1.8 | 0.5 | 820 | 41 | ○ |
| 140 | 482 | 407 | 1.9 | 0.6 | 825 | 41 | ○ |
| 141 | 481 | 407 | 2.0 | 0.6 | 829 | 42 | ○ |
| 142 | 468 | 393 | 1.8 | 0.5 | 810 | 43 | ○ |
| 143 | 472 | 400 | 1.9 | 0.6 | 815 | 43 | ○ |
| 144 | 477 | 402 | 1.9 | 0.6 | 819 | 44 | ○ |
| 145 | 486 | 410 | 2.0 | 0.5 | 835 | 42 | ○ |
| 146 | 491 | 416 | 2.0 | 0.5 | 840 | 42 | ○ |
| 147 | 495 | 418 | 2.1 | 0.7 | 844 | 43 | ○ |
| 148 | 478 | 403 | 1.9 | 0.7 | 830 | 43 | ○ |
| 149 | 489 | 412 | 2.0 | 0.6 | 835 | 43 | ○ |
| 150 | 487 | 412 | 2.0 | 0.6 | 839 | 44 | ○ |
| 151 | 480 | 403 | 1.8 | 0.5 | 830 | 42 | ○ |
| 152 | 487 | 412 | 1.9 | 0.6 | 835 | 42 | ○ |
| 153 | 489 | 412 | 1.9 | 0.6 | 839 | 43 | ○ |
| 154 | 473 | 398 | 1.7 | 0.5 | 820 | 44 | ○ |
| 155 | 484 | 407 | 1.8 | 0.6 | 825 | 44 | ○ |
| 156 | 482 | 407 | 1.8 | 0.6 | 829 | 45 | ○ |
| 157 | 489 | 412 | 1.9 | 0.5 | 845 | 43 | ○ |
| 158 | 492 | 417 | 1.9 | 0.5 | 850 | 43 | ○ |
| 159 | 491 | 418 | 2.0 | 0.6 | 854 | 44 | ○ |

| | No. | Kb before acid pickling/polishing (MPa) | Kb after acid pickling/polishing (MPa) | Peak height ratio at β angle of 90° | Second phase particles having particle size of from 0.1 μm to 1 μm (×10^5) | YS (MPa) | EC (% IACS) | Solder wettability t2 (s) |
|---|---|---|---|---|---|---|---|---|
| Example | 127 | 682 | 625 | 3.0 | 51.9 | 866 | 48 | ○ |
| Example | 128 | 687 | 631 | 3.0 | 52.0 | 871 | 49 | ○ |
| Example | 129 | 690 | 635 | 3.1 | 52.0 | 876 | 49 | ○ |

TABLE 2-continued

| | | | | | | | | |
|---|---|---|---|---|---|---|---|---|
| Example | 130 | 649 | 593 | 2.8 | 51.7 | 733 | 55 | ○ |
| Example | 131 | 661 | 605 | 2.9 | 51.7 | 738 | 56 | ○ |
| Example | 132 | 664 | 609 | 2.8 | 51.7 | 746 | 56 | ○ |
| Example | 133 | 703 | 647 | 3.2 | 55.0 | 945 | 42 | ○ |
| Example | 134 | 715 | 657 | 3.2 | 55.0 | 951 | 43 | ○ |
| Example | 135 | 716 | 660 | 3.2 | 55.1 | 956 | 43 | ○ |
| Example | 136 | 680 | 625 | 2.8 | 64.6 | 872 | 50 | ○ |
| Example | 137 | 693 | 637 | 2.9 | 64.7 | 877 | 51 | ○ |
| Example | 138 | 695 | 640 | 3.0 | 64.7 | 882 | 49 | ○ |
| Example | 139 | 656 | 600 | 2.6 | 64.3 | 739 | 55 | ○ |
| Example | 140 | 667 | 612 | 2.7 | 64.4 | 744 | 56 | ○ |
| Example | 141 | 672 | 616 | 2.7 | 64.4 | 752 | 56 | ○ |
| Example | 142 | 709 | 655 | 3.0 | 71.1 | 951 | 42 | ○ |
| Example | 143 | 720 | 665 | 3.0 | 71.2 | 957 | 43 | ○ |
| Example | 144 | 722 | 668 | 3.0 | 71.2 | 962 | 43 | ○ |
| Comparative Example | 160 | 628 | 555 | 1.9 | 51.0 | 863 | 48 | ○ |
| Comparative Example | 161 | 603 | 528 | 1.6 | 50.0 | 728 | 55 | ○ |
| Comparative Example | 162 | 645 | 572 | 2.0 | 54.0 | 938 | 43 | ○ |
| Comparative Example | 163 | 623 | 545 | 2.0 | 60.0 | 870 | 48 | ○ |
| Comparative Example | 164 | 585 | 507 | 1.9 | 58.0 | 735 | 55 | ○ |
| Comparative Example | 165 | 635 | 560 | 2.1 | 63.0 | 945 | 42 | ○ |

Examples No. 1 to 126 have peak height ratios at a β angle of 90° of 2.5 or greater, and it is understood that these Examples are excellent in the balance between strength, electrical conductivity, and spring bending elastic limit.

Comparative Examples No. 1 to 6 and Comparative Examples No. 58 to 63 are examples of conducting the first aging by two-stage aging.

Comparative Examples No. 7 to 12 and Comparative Examples No. 64 to 69 are examples of conducting the first aging by single-stage aging.

Comparative Examples No. 13 to 57, Comparative Examples No. 70 to 114, and Comparative Examples No. 124 to 159 are examples with short aging times of the third stage.

Comparative Examples No. 115 to 117 are examples with low aging temperatures of the third stage.

Comparative Examples No. 118 to 120 are examples with high aging temperatures of the third stage.

Comparative Examples No. 121 to 123 are examples with long aging times of the third stage.

Figure 2:
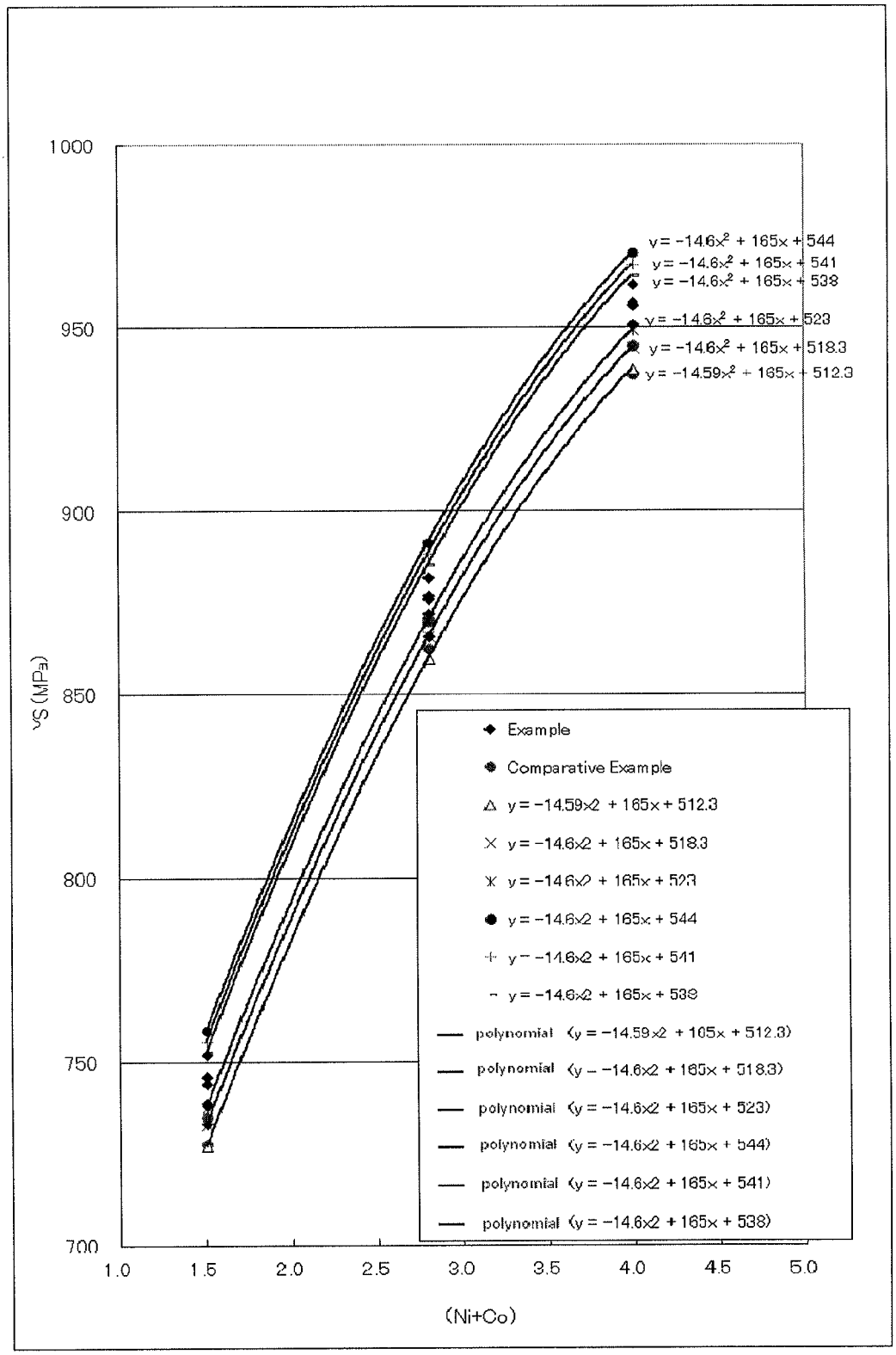
FIG. 2 is a diagram obtained by plotting the total concentration in mass percentage (%) of Ni and Co (Ni+Co) on the x-axis and YS on the y-axis in relation to Examples No. 127 to 144 and Comparative Examples No. 160 to 165.
Figure 3:
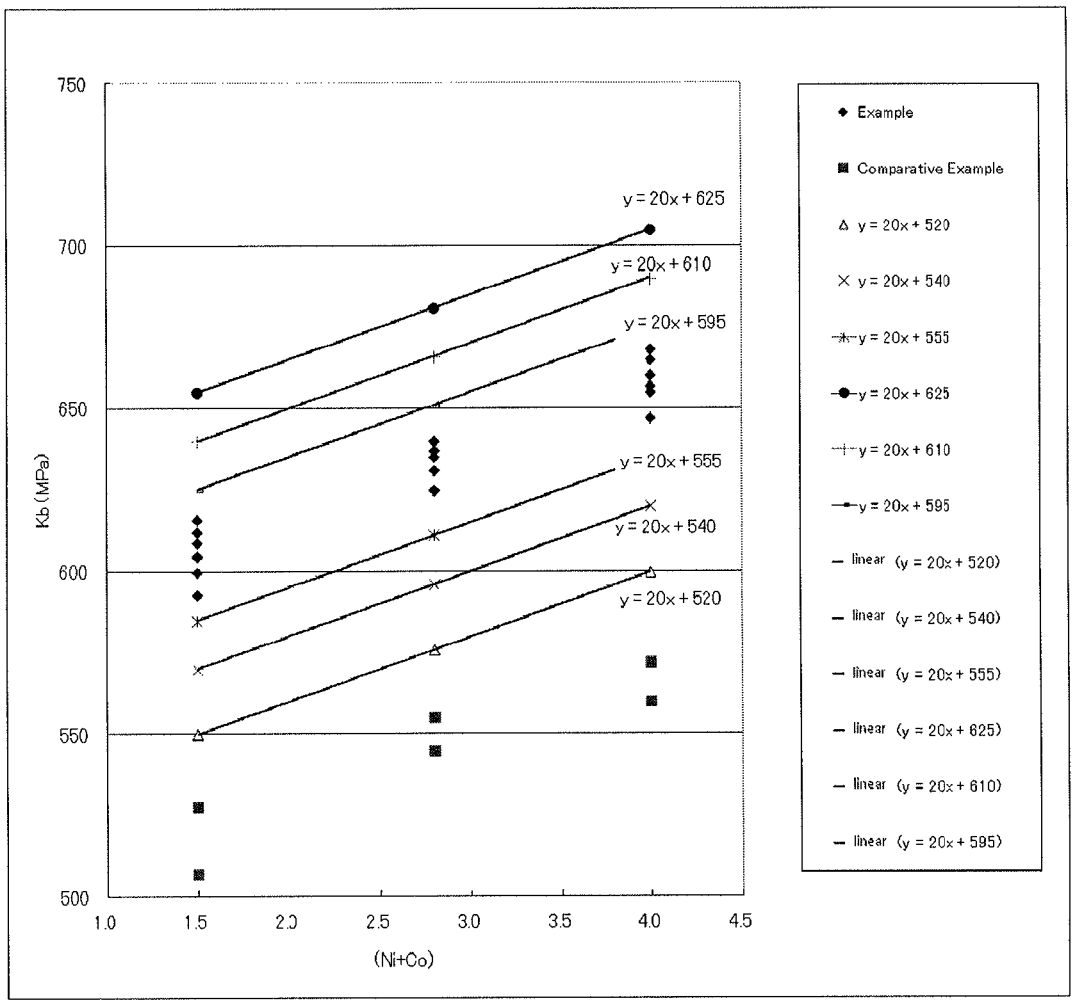
FIG. 3 is a diagram obtained by plotting the total concentration in mass percentage (%) of Ni and Co (Ni+Co) on the x-axis and YS on the y-axis in relation to Examples No. 127 to 144 and Comparative Examples No. 160 to 165.

All of the Comparative Examples have peak height ratios at a β angle of 90° of less than 2.5, and it is understood that the Comparative Examples are poorer in the balance between strength, electrical conductivity, and spring bending elastic limit as compared with Examples Furthermore, the same results were obtained for the comparison of Examples No. 127 to 144 and Comparative Examples No. 160 to 165, in which the cooling conditions after the solution heat treatment were changed. In relation to these Examples, a diagram plotting YS on the x-axis and Kb on the y-axis is presented in FIG. 1; a diagram plotting the total mass % concentration of Ni and Co (Ni+Co) on the x-axis and YS on the y-axis is presented in FIG. 2; and a diagram plotting the total mass % concentration of Ni and Co (Ni+Co) on the x-axis and YS on the y-axis is presented in FIG. 3. From FIG. 1, it is understood that the copper alloys according to Examples No. 127 to 144 satisfy the relationship: 0.23×YS+480≥Kb≥0.23×YS+390. From FIG. 2, it is understood that the copper alloys according to Examples No. 127 to 144 satisfy Formula A: −14.6×(Ni concentration+Co concentration)$^2$+165×(Ni concentration+Co concentration)+544≥YS≥−14.6×(Ni concentration+Co concentration)$^2$+165×(Ni concentration+Co concentration)+512.3. From FIG. 3, it is understood that the copper alloys according to Examples No. 127 to 144 satisfy the formula:

20×(Ni concentration+Co concentration)+625≥*Kb*≥20×(Ni concentration+Co concentration)+520.

The invention claimed is:

1. A copper alloy for electronic materials, comprising 1.0% to 2.5% by mass of Ni, 0.5% to 2.5% by mass of Co, and 0.3% to 1.2% by mass of Si, optionally 0.03% to 0.5% by mass of Cr, and optionally at least one member selected from the group consisting of Mg, P, As, Sb, Be, B, Mn, Sn, Ti, Zr, Al, Fe, Zn and Ag in a total amount of 2.0% by mass at the maximum, with the balance being Cu and unavoidable impurities, wherein from the results obtainable by an X-ray diffraction pole figure analysis using a rolled surface as a base, among the diffraction peak intensities of the {111}Cu plane with respect to the {200}Cu plane obtained by β scanning at α=35°, the peak height at a β angle of 90° of the copper alloy is at least 2.5 times the peak height of a standard copper powder, wherein the copper alloy satisfies the following formula:

20×(Ni concentration+Co concentration)+625≥Kb≥20×(Ni concentration+Co concentration)+520 Formula B wherein the unit of Ni concentration and the unit of Co concentration is percent (%) by mass, and Kb represents spring bending elastic limit.

2. The copper alloy according to claim 1, wherein the number density of particles having a particle size of from 0.1 μm to 1 μm among second phase particles precipitated in a matrix phase is $5\times10^5$ to $1\times10^7$ particles/mm$^2$.

3. The copper alloy according to claim 1, satisfying the following formula:

−14.6×(Ni concentration+Co concentration)$^2$+165×(Ni concentration+Co concentration)+544≥*YS*≥−14.6×(Ni concentration+Co concentration)$^2$+165×(Ni concentration+Co concentration)+512.3 Formula A wherein the unit of the Ni concentration and the Co concentration is percent (%) by mass and YS represents 0.2% yield strength.

4. The copper alloy according to claim 1, wherein the relationship between Kb and YS satisfies the following formula:

$$0.23\times YS+480\geq Kb\geq 0.23\times YS+390 \quad \text{Formula C}$$

wherein YS represents 0.2% yield strength; and Kb represents spring bending elastic limit.

5. The copper alloy according to claim 1, wherein the ratio of the total mass concentration of Ni and Co to the mass concentration of Si, [Ni+Co]/[Si], satisfies the relationship: $4\leq[Ni+Co]/Si\leq 5$.

6. The copper alloy according to claim 1, further comprising Cr: 0.03% to 0.5% by mass.

7. The copper alloy according to claim 1, further comprising at least one selected from the group consisting of Mg, P, As, Sb, Be, B, Mn, Sn, Ti, Zr, Al, Fe, Zn and Ag in a total amount of 2.0% by mass at the maximum.

8. A method for producing a copper alloy according to claim 1, the method comprising the following steps, in order:

(1) melting and casting an ingot of a copper alloy having the composition according to claim 1;

(2) heating the material for one hour or longer at a temperature of from 950° C. to 1050° C., subsequently performing hot rolling, adjusting the temperature at the time of completion of hot rolling to 850° C. or higher, and cooling the material with an average cooling rate from 850° C. to 400° C. at 15° C./s or greater;

(3) performing cold rolling;

(4) conducting a solution heat treatment at a temperature of from 850° C. to 1050° C., and cooling the material with an average cooling rate to 400° C. at 10° C. or more per second;

(5) conducting a first aging treatment involving multistage aging, which includes a first stage of heating the material at a material temperature of 400° C. to 500° C. for 1 to 12 hours, subsequently a second stage of heating the material at a material temperature of 350° C. to 450° C. for 1 to 12 hours, and subsequently a third stage of heating the material at a material temperature of 260° C. to 340° C. for 4 to 30 hours, wherein the cooling rate from the first stage to the second stage and the cooling rate from the second stage to the third stage is set at 1° C. to 8° C./min, respectively, the temperature difference between the first stage and the second stage is adjusted to 20° C. to 60° C., and the temperature difference between the second stage and the third stage is adjusted to 20° C. to 180° C.;

(6) performing cold rolling; and (7) conducting a second aging treatment at a temperature of higher than or equal to 100° C. and lower than 350° C. for 1 to 48 hours.

9. The method according to claim 8, wherein after the solution heat treatment in step (4), instead of the cooling conditions of cooling to 400° C. at an average cooling rate of 10° C. or more per second, cooling is carried out at an average cooling rate of greater than or equal to 1° C./s and less than 15° C./s until the material temperature falls to 650° C., and at an average cooling rate of 15° C./s or greater until the temperature falls from 650° C. to 400° C.

10. The method according to claim 8, further comprising a step (8) of performing acid pickling and/or polishing, after step (7).

11. A wrought copper product made of the copper alloy according to claim 1.

12. An electronic component comprising the copper alloy according to claim 1.

* * * * *